US007304258B2

(12) United States Patent
Lean et al.

(10) Patent No.: US 7,304,258 B2
(45) Date of Patent: Dec. 4, 2007

(54) SYSTEM FOR TRANSPORTING AND SELECTIVELY SORTING PARTICLES AND METHOD OF USING THE SAME

(75) Inventors: Meng H. Lean, Santa Clara, CA (US); John J. Ricciardelli, Poughkeepsie, NY (US); Osman Todd Polatkan, North Haledon, NJ (US); Michael J. Savino, Tappan, NY (US); Eric Peeters, Fremont, CA (US); Scott Elrod, La Honda, CA (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/731,971

(22) Filed: Apr. 2, 2007

(65) Prior Publication Data

US 2007/0175801 A1 Aug. 2, 2007

Related U.S. Application Data

(62) Division of application No. 10/612,122, filed on Jul. 2, 2003, now Pat. No. 7,217,901.

(51) Int. Cl.
*B03C 7/00* (2006.01)

(52) U.S. Cl. ..... 209/127.1; 209/1; 209/12.1; 209/131; 204/643

(58) Field of Classification Search ..... 209/127.1–131, 209/1, 12.1, 12.2, 19; 347/57; 204/547, 204/643

See application file for complete search history.

(56) References Cited

U.S. PATENT DOCUMENTS 4,647,179 A 3/1987 Schmidlin
5,133,844 A 7/1992 Stevens
5,551,642 A 9/1996 Dunn
5,570,789 A 11/1996 Dunn
5,626,734 A 5/1997 Docoslis et al.
5,824,389 A 10/1998 Rostoker
5,932,100 A 8/1999 Yager et al.
6,180,906 B1 1/2001 Trainoff
6,320,148 B1 11/2001 Yoon et al.
6,365,856 B1 4/2002 Whitelaw
6,499,831 B2 12/2002 Schmidlin
6,773,489 B2 8/2004 Dunn
6,789,679 B2 9/2004 Abrarov et al.
6,881,314 B1 4/2005 Wang et al.

OTHER PUBLICATIONS

Desai, et al., "A MEMS electrostatic particle transportation system," Sensors and Actuators 73, (1999) pp. 37-44.

Schmidlin, "Advances in Traveling Wave Toner Transport," IS & Ts NIP 15: 1999 International Conference on Digital Printing Technologies, pp. 302-305.

*Primary Examiner*—Patrick Mackey
*Assistant Examiner*—Mark Hageman
(74) *Attorney, Agent, or Firm*—Fay Sharpe LLP

(57) ABSTRACT

A system for transporting and selectively sorting particles includes a first wall and a traveling wave grid extending along the first wall. The system includes a second wall having a passage extending therethrough and a gate operatively associated with the passage. A controller is adapted to output a multi-phase electrical signal. The controller is in communication with the traveling wave grid and the gate. A method of using the system is also provided.

16 Claims, 25 Drawing Sheets

FIG. 26
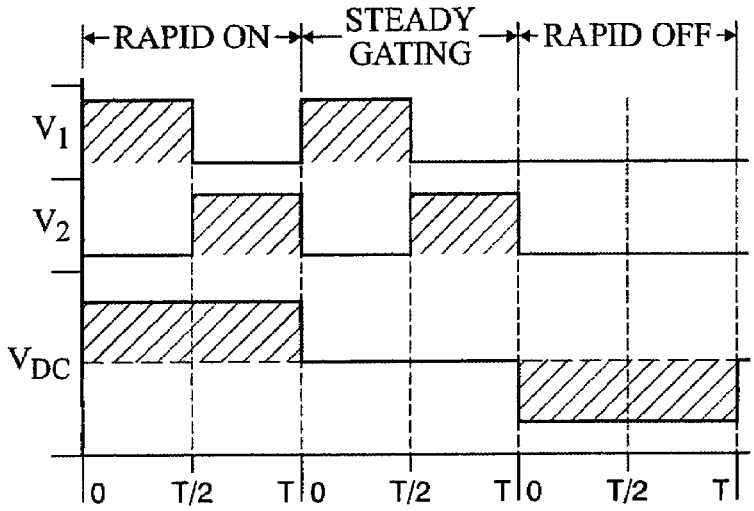
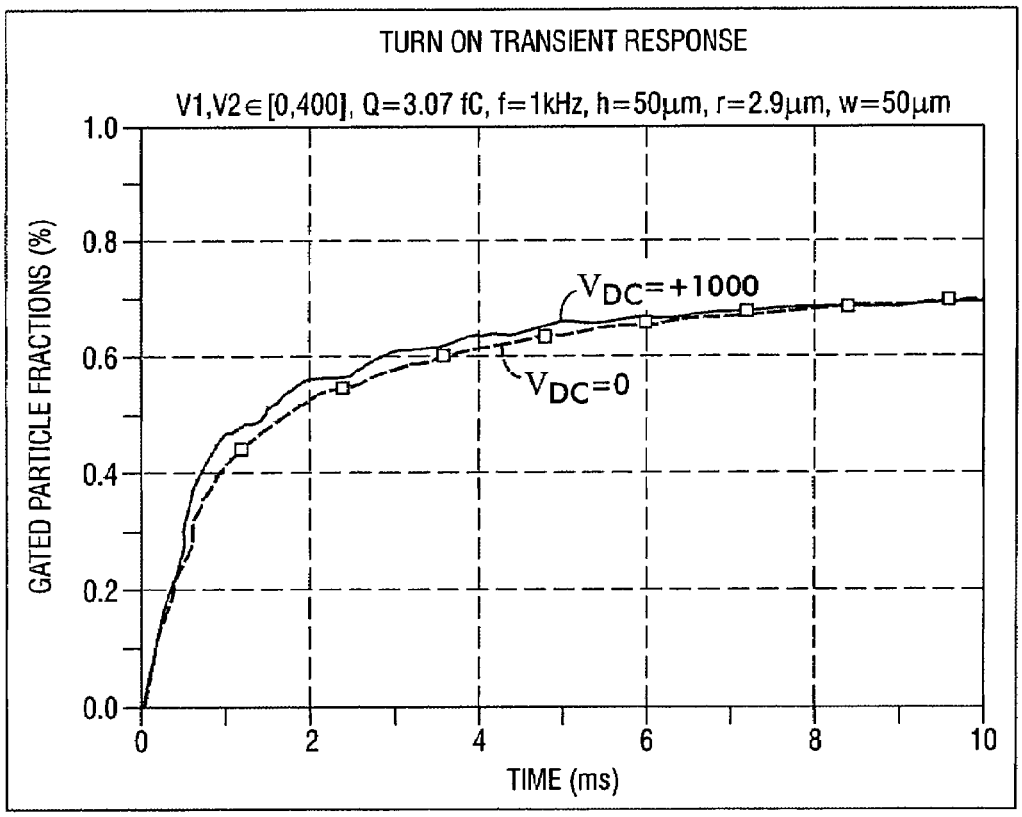
FIG. 27

FIG. 28
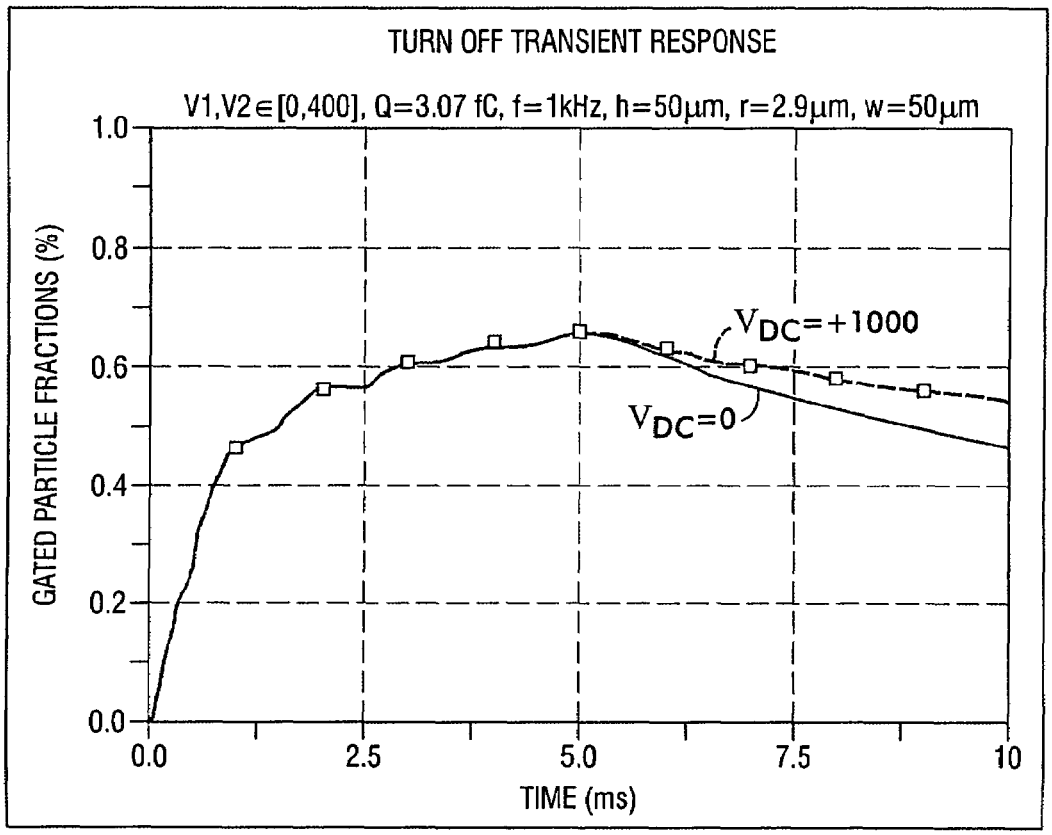
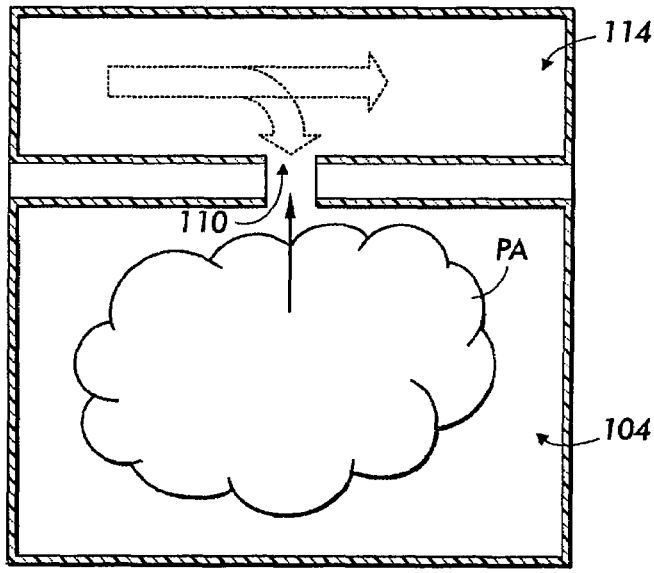
FIG. 29

FIG. 30
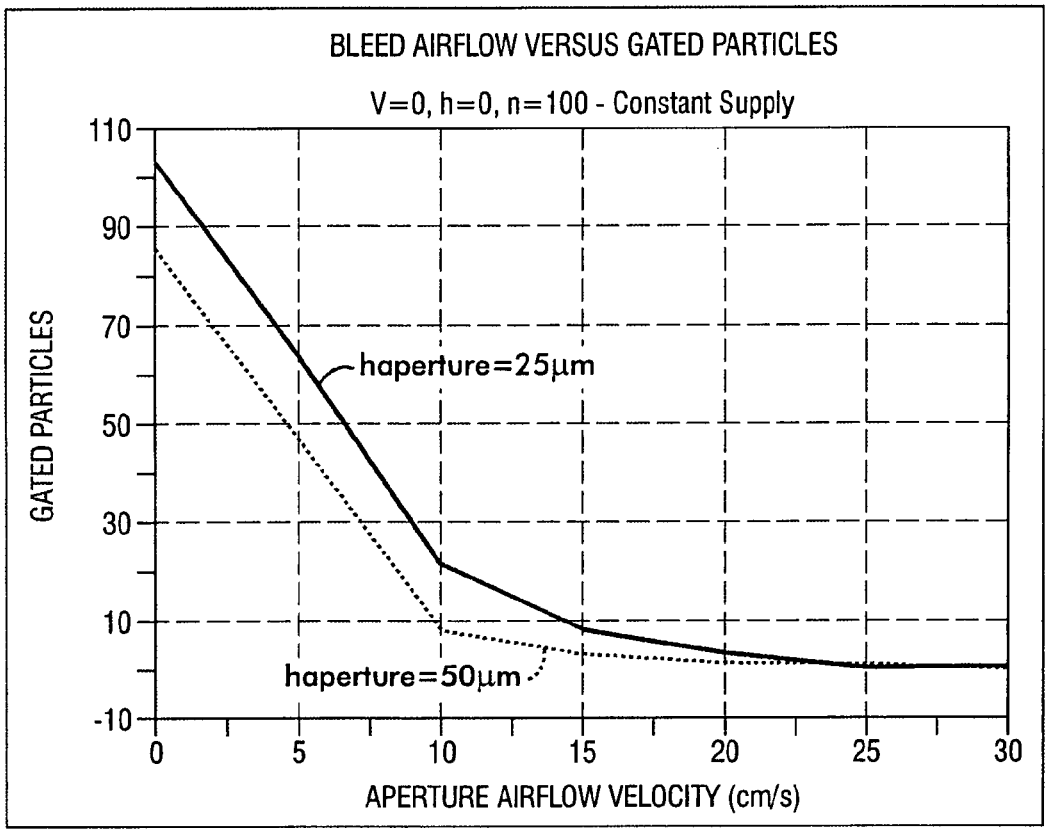
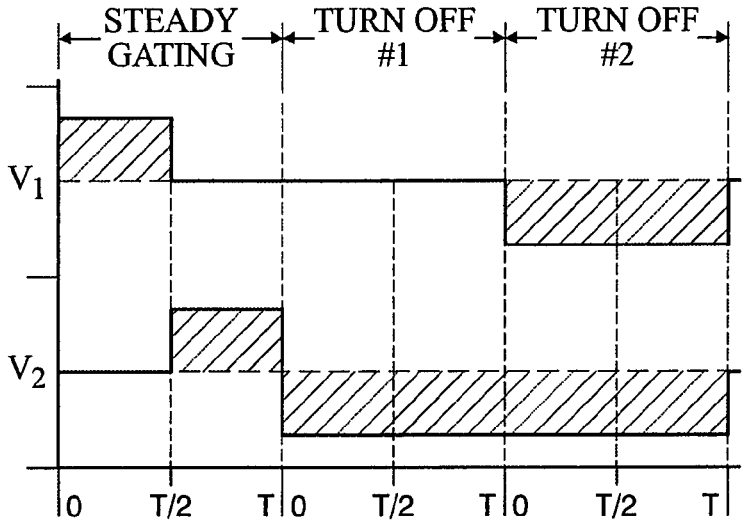
FIG. 31

SYSTEM FOR TRANSPORTING AND SELECTIVELY SORTING PARTICLES AND METHOD OF USING THE SAME

This application is a divisional of application Ser. No. 10/612,122, filed Jul. 2, 2003 now U.S. Pat. No. 7,217,901. Application Ser. No. 10/612,122 filed Jul. 2, 2003 is incorporated herein by reference in its entirety.

The present invention broadly relates to the art of material handling and processing and, more particularly, to a system and method for transporting particles and selectively sorting the same during transport.

BACKGROUND OF THE INVENTION

The present invention relates broadly to the art of transporting and selectively sorting minute particles, such as fine powders, for example. It finds particular application in conjunction with the handling and processing of pharmaceutical and non-pharmaceutical ingredients and compounds, and will be described herein with particular reference thereto. However, it is to be specifically understood that the present invention can be used in a wide range of other applications, and is equally applicable in a variety of other industries, such as biotechnology, chemical production and processing and other material handling and processing applications, for example. As such, the present invention is not intended to be in any way limited or constrained to uses and/or applications within the pharmaceutical industry.

In the pharmaceutical industry, as well as other industries, there is a need for bulk quantities of uniformly sized particles. Such particles are commonly in the form of dry powders, and typically possess an electrostatic charge. In the production of medicines, for example, the uniformly sized particles are important for both intermediate processing during manufacturing, for producing products having the proper dosage and for timed-release of medication during usage. Unfortunately, bulk quantities of ingredients and compounds often include particles in a wide variety of sizes. For example, particles having a dimension ranging from about 1.0 μm to about 100 μm are common. As such, it is commonly desirable to separate or sort the particles into two or more groups according to size.

Typically, the sorting of bulk quantities of particles is accomplished using mechanical devices, such as sieves, screens and/or other sizing machines. There are numerous disadvantages that are commonly associated with the use of such equipment. One such disadvantage is that commonly associated with mechanical equipment in general. That is, mechanical devices have moving parts that require maintenance and repair. This causes losses due to decreased production, as well as the direct costs of such maintenance and repairs.

Another disadvantage of mechanical sorting devices is that the same can create fines or fragments of particles. These can cause screens in mechanical sorting devices to become clogged, and can also negatively effect the quality and consistency of the sorted particles.

Still another disadvantage of traditional mechanical devices is that conveyors or other similar material moving devices are required to move the bulk particles from one sorting machine to the next, as the particles become more and more separated. This adds additional costs and complexities to the system.

Devices suitable for transporting bulk quantities of particles, such as toner for copy machines, for example, have been developed that use electrostatic traveling waves to move the particles. While these devices overcome some of the disadvantages of mechanical conveyors, devices using electrostatic traveling waves have to date presented shortcomings that have limited their utility. One shortcoming is that for image development, these devices often require particles having specific characteristics, such as a certain electrical charge magnitude, polarity or other property, for example.

Other traveling wave arrangements are based on the use of dipolar forces. One disadvantage of such arrangements is that these devices commonly operate using very high voltages, such as about 2000 V, operate at very high frequencies, such as about 10-100 Mhz, and require very fine line pitches between conductors, such as about 10 μm or less, for example. Additionally, these types of traveling wave devices do nothing to overcome the disadvantages of mechanical sorting devices.

SUMMARY OF THE INVENTION

In accordance with the present invention, a system and method for transporting and selectively sorting particles during transport is provided and can be used in various applications, such as the manufacture of pharmaceutical and non-pharmaceutical products, for example. The system and method of using the same avoid or minimize the problems and disadvantages encountered in connection with known systems and devices of the foregoing character, while promoting the efficient transport and sorting of particles without the use of mechanical moving parts, and while maintaining a desired simplicity of structure and economy of manufacture.

More particularly in this respect, a system for transporting and selectively sorting particles is provided. The system includes a first wall and a traveling wave grid extending along the first wall. The system also includes a second wall that has a passage extending therethrough. A gate is operatively associated with the passage, and a controller is provided that is in electrical communication with the traveling wave grid and the gate. The controller is adapted to provide a multi-phase electrical signal to at least one of the traveling wave grid and the gate.

Additionally, a system for transporting and selectively sorting particles is provided that includes a housing having a first wall that at least partially defines a first transport channel and a second wall at least partially defining a second transport channel. A gating passage extends in fluid communication between the first and the second transport channels. The system also includes a traveling wave grid disposed along the first transport channel, and a gate operatively associated with the gating passage. A voltage source is included that is in electrical communication with the traveling wave grid and the gate. The voltage source is adapted to output a multi-phase voltage signal to at least one of the traveling wave grid and the gate.

Furthermore, a method of transporting and selectively sorting particles is provided that can include the following steps. One step includes providing a first wall at least partially forming a first chamber, a second wall at least partially forming a second chamber, and a passage wall at least partially defining a passage extending in fluid communication between the first and second chambers. The step also includes providing a traveling wave grid disposed along the first wall, a gate operatively associated with the passage, and a controller in electrical communication with the traveling wave grid and the gate. The controller is adapted to output a multi-phase electrical signal to at least one of the traveling wave grid and the gate. Another step includes introducing a quantity of separable particles into the first chamber. Still another step includes applying a multi-phase electrical signal from the controller across at least a portion of the traveling wave grid inducing flow of the quantity of separable particles along the first chamber. Yet another step includes selectively gating a portion of the quantity of separable particles flowing along the first chamber into the second chamber.

BRIEF DESCRIPTION OF THE DRAWINGS

FIG. 26 is a voltage pattern illustrating applied voltage signals for various gating conditions.

FIG. 27 is a graph of gated particle fractions as a function of time with a gate in accordance with the present invention operated using a transient response circuit as the gate is turned on.

FIG. 28 is a graph of gated particle fractions as a function of time with a gate in accordance with the present invention operated without using a transient response circuit as the gate is turned off.

FIG. 29 schematically illustrates gaseous fluid flow through a gate in accordance with the present invention to shut off particle flow therethrough.

FIG. 30 is a graph of gated particles as a function of fluid flow velocity through a gate in accordance with the present invention.

FIG. 31 is a voltage pattern illustrating applied voltage signals for shutting off particle flow through a gate in accordance with the present invention in use with gaseous fluid flow therethrough.

DETAILED DESCRIPTION OF THE INVENTION

Figure 1:
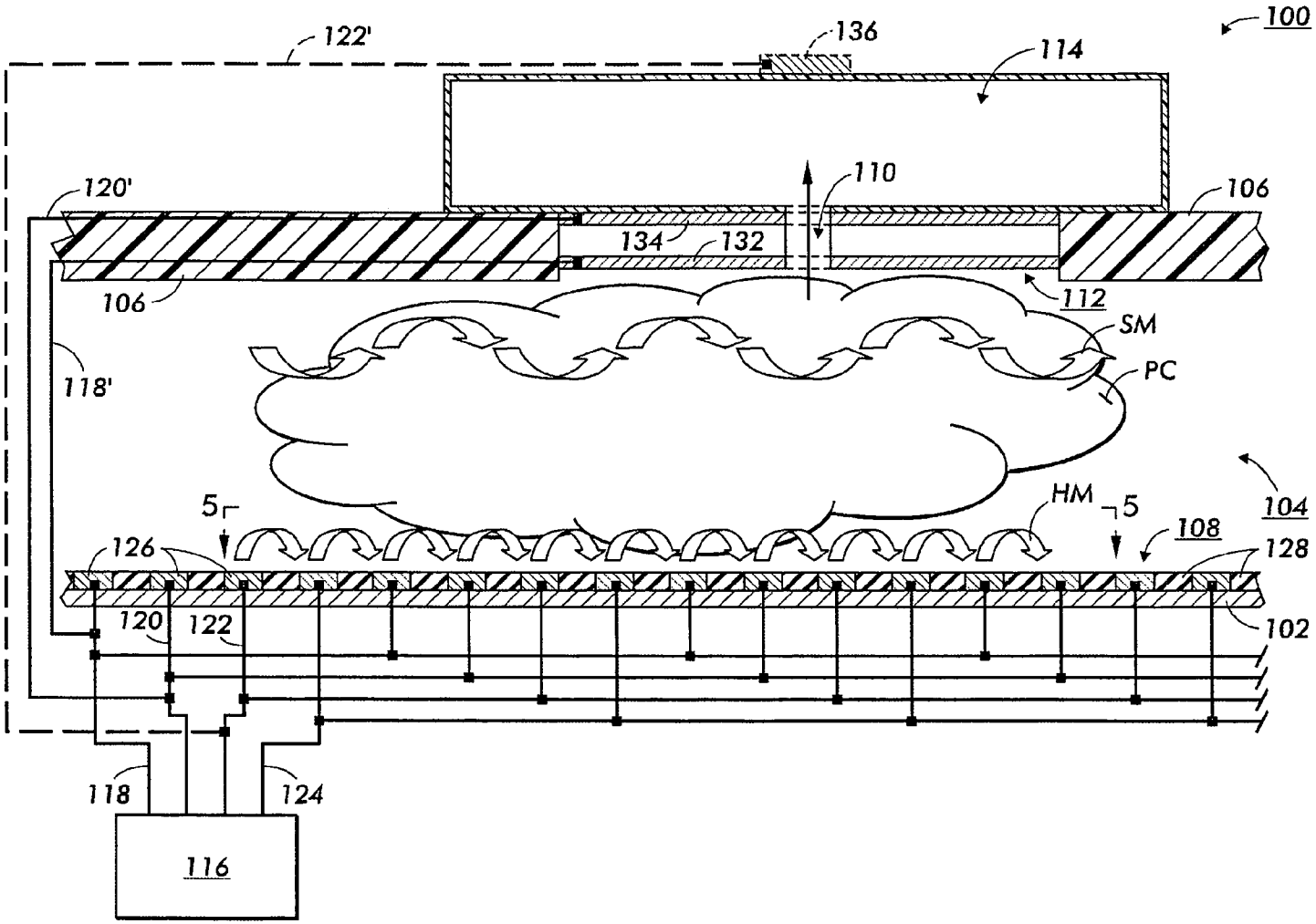
FIG. 1 is a side elevation view of one embodiment of a system in accordance with the present invention with a transport channel and gating passage and showing two modes of particle motion through the transport channel.

Turning now to the drawings, wherein the showings are for the purposes of illustrating preferred embodiments of the invention only and not for the purposes of limiting the invention, FIG. 1 illustrates a system 100 for transporting and selectively sorting particles. System 100 includes a wall 102 at least partially forming a transport channel 104. Another wall 106 is disposed in spaced relation to wall 102 and, in this embodiment, extends substantially parallel thereto. A traveling wave grid 108 is disposed along wall 102 and generates an electrostatic traveling wave suitable for inducing particles to move along channel 104. A particle gating passage 110 extends through wall 106. A gate 112 is operatively associated with passage 110 to selectively induce particles to flow through the passage and into a chamber 114 or other suitable feature disposed adjacent the passage opposite channel 104.

Figure 2:
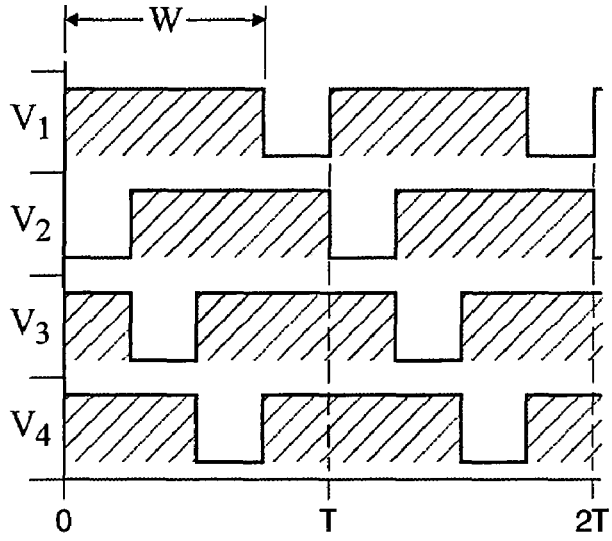
FIG. 2 is a voltage pattern suitable for 4-phase operation of the traveling wave grid shown in FIG. 1.

System 100 also includes a power supply 116 that is in electrical communication with grid 108 and gate 112. Power supply 116 is preferably adapted to output multi-phase electrical signals, such as voltage or current patterns, for example. One suitable voltage pattern is shown in FIG. 2. The voltage pattern shows four voltage waves V1, V2, V3 and V4 spaced at 90 degree phase angles. The duty cycle W for each voltage wave is shown in FIG. 2 as about being 75 percent of time unit T.

In the embodiment shown in FIG. 1, power supply 116 is adapted to output AC electrical signals in four-phases with each phase applied along a different one of electrical connectors 118, 120, 122 and 124. The connectors are shown in FIG. 1 as being in electrical communication with electrodes or conductors 126 that are arranged in an inter-digitized pattern. However, it will be appreciated that any suitable pattern or configuration can be used. A suitable insulating material 128 can optionally be provided between adjacent conductors to minimize air gaps.

Figure 3:
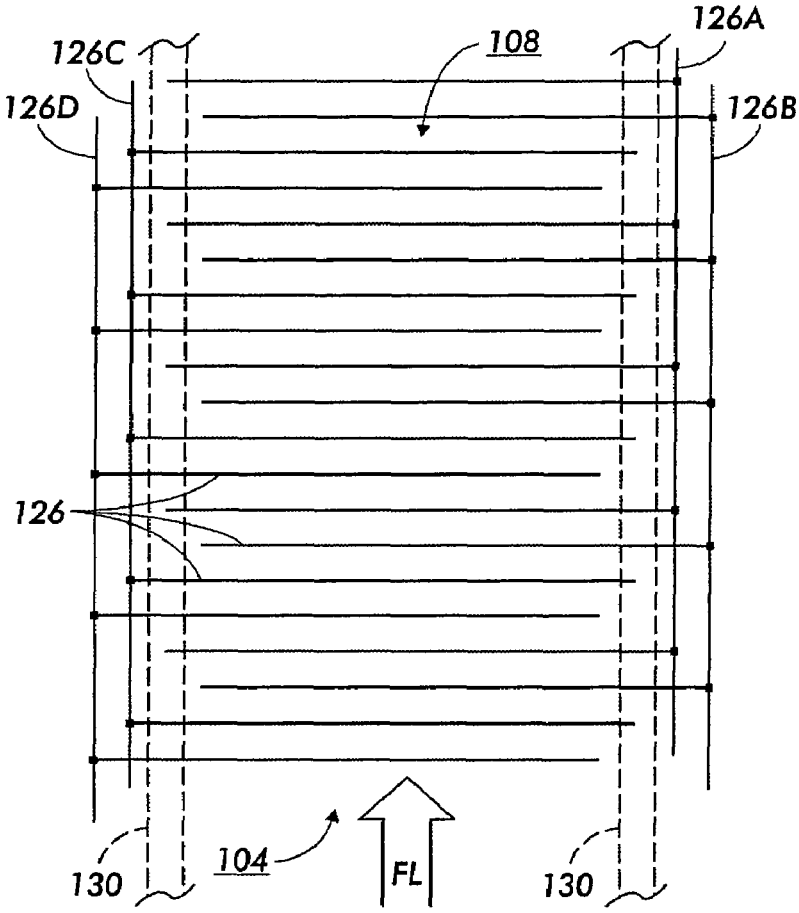
FIG. 3 is a top plan view of the traveling wave grid shown in FIG. 1.
Figure 4:
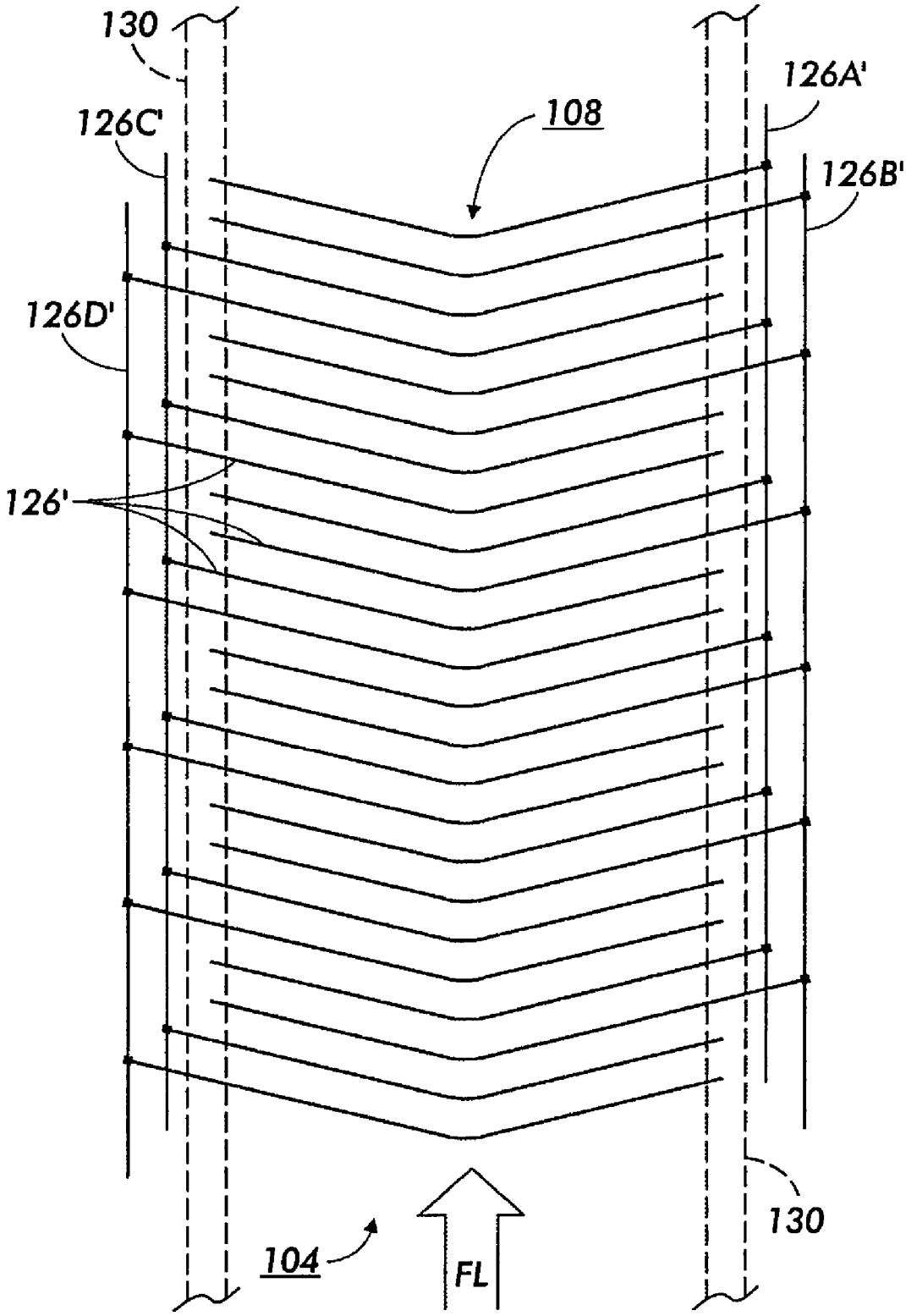
FIG. 4 is a top plan view of another embodiment of the traveling wave grid shown in FIG. 3.

As shown in FIG. 3, conductors 126 are formed in four conductor groups 126A, 126B, 126C and 126D that are inter-digitized with one another to form traveling wave grid 108. The conductors in FIG. 3 extend transverse channel 104 in a substantially linear manner. Other configurations can be used, however, such as conductors 126' of conductor groups 126A', 126B', 126C' and 126D' in FIG. 4. One benefit of conductors 126' is that the chevron shape assists in focusing the particle cloud within a central region of the transport channel. Transport channel 104 is demarcated by side walls 130, in FIGS. 3 and 4. Particle flow along the channel is indicated by arrow FL, in each of FIGS. 3 and 4.

In one example of a suitable traveling wave grid, the conductors are spaced at a pitch of about 200 μm. As such, the corresponding conductor phase on each of the conductor groups are spaced apart a distance of about 800 μm, in this example. The traveling wave grid can include a base layer formed from a suitable dielectric material, such as a polyimide film, for example. One example of a suitable polyimide film is sold under the trademark KAPTON by DuPont High Performance Materials of Circleville, Ohio. One suitable thickness range for the polyimide film can be from about 25 μm to about 200 μm thick, and in one example of a suitable embodiment, the polyimide film is about 75 μm thick. The conductor groups and conductors thereof are formed from a suitable conductive material, such as gold, silver, or copper, for example. It will be appreciated, however, that any suitable conductive material can be used, and the same are not limited to metal materials. In one example of a suitable embodiment, the conductors and conductor groups are made from copper and can be from about 1 μm thick to about 15 μm thick. The width of the conductors are often expressed as a percentage of the pitch of the grid and can be from about 10 percent of the pitch to about 50 percent of the pitch. A cover layer can also be provided along the grid covering the conductors and/or conductor groups to maintain electrical isolation from the charged particles. The cover layer can be formed from any suitable material, such as polyvinyl fluoride film, for example. One suitable polyvinyl fluoride film is sold under the trademark TEDLAR by DuPont Tedlar of Buffalo, N.Y. In one example of a suitable embodiment, a cover layer of TEDLAR film from about 5 μm thick to about 50 μm thick can be used. One suitable type of insulating material 128 is a non-conductive epoxy, such as those well known in the art, that can be used to fill the inter-conductor spacings and minimize the air gaps under the cover layer. It will be appreciated that the foregoing examples are merely illustrative of suitable materials and that any other suitable materials can be used.

Gate 112 includes a first electrode 132 and a second electrode 134 in spaced relation to one another. Gate 112 can optionally include a third electrode 136, as shown in FIG. 1. In the embodiment shown in FIG. 1, electrodes 132 and 134 are in electrical communication with power supply 116 along connectors 118' and 120' that respectively extend from connectors 118 and 120. As such, it will be appreciated that the gate operates on two phases of the four-phase output from the power supply. Third electrode 136 can be in electrical communication with power supply 116 along connector 122' that extends from connector 122, such that gate 112 operates on three phases. Alternately, a separate electrical signal, such as a DC voltage, for example, could be applied to the third electrode.

In operation, a particle cloud PC is disposed at one end of channel 104. The cloud is typically formed of particles having two or more particle sizes and/or electrical charge magnitudes. It will be appreciated that particles having a single electrical polarity, either positive or negative, can be used. However, to maximize the capabilities and productivity of a system in accordance with the present invention, it is preferable to use a population of particles that includes particles of both polarities. However, this should not be in any way construed as a requirement or limitation of the system.

As discussed above, a multi-phase electrical signal, such as a four-phase AC voltage pattern, for example, is applied across the traveling wave grid driving an electrostatic traveling wave along the grid. The electrostatic traveling wave induces at least two modes of particle movement within the particle cloud. The velocity of transport along the grid scales linearly with the frequency of the electrical signal. In one example of a suitable electrical signal, the voltage waves can cycle at from about 1 Hz to about 5 kHz to achieve the desired particle velocity.

Figure 5:
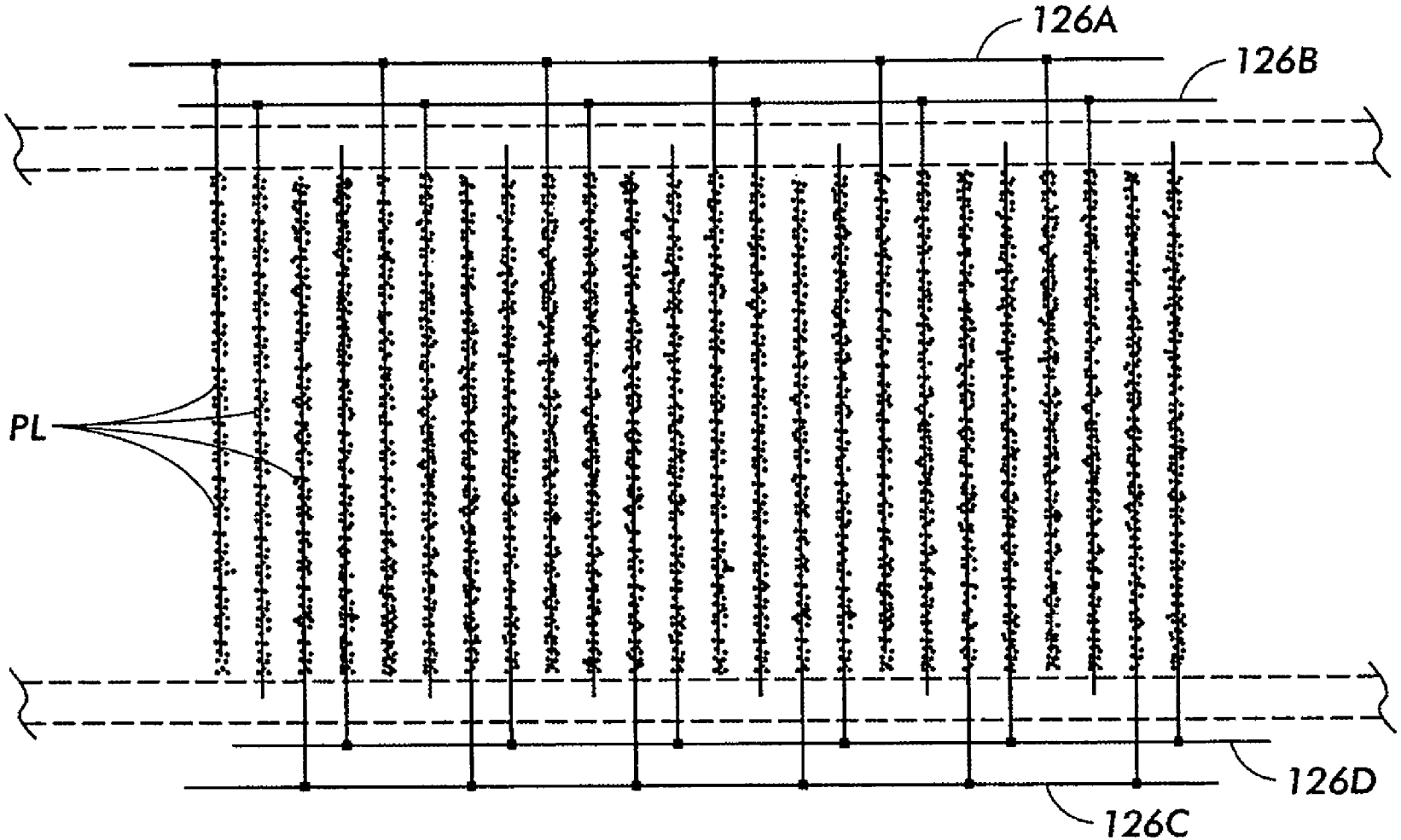
FIG. 5 is a top plan view taken along line 5-5 in FIG. 1 of the transport channel showing a traveling wave grid and particles aligned therealong during transport.

One mode of particle movement, termed a "hopping" mode for convenience and ease of reading, occurs as particles jump from conductor to conductor along the traveling wave grid in a manner substantially synchronous with the electrostatic traveling wave. The hopping mode is schematically shown in FIG. 1 by arrows HM, and an illustration of the alignment of particles PL along conductors 126 (FIG. 3), which extend from conductor groups 126A, 126B, 126C and 126D, is shown in FIG. 5.

A second mode of particle motion, termed a "surfing" mode for convenience and ease of reading, flows along the channel above the particles in hopping mode. The surfing mode is schematically shown in FIG. 1 by arrows SM. Due to various forces and other factors, such as viscous drag forces, buoyancy forces, collisional forces and particle scattering, for example, the particles in surfing mode typically have a low agglomeration and are suspended in a state of substantial equilibrium above the particles in hopping mode. The particles in surfing mode are sufficiently distanced from the traveling wave grid to be substantially influenced by the electrostatic forces thereof. As such, the particles in surfing mode tend to flow along the channel in a manner that is slower and asyncronized to those particles in hopping mode and to the electrostatic traveling wave. As the low agglomeration particles in surfing mode flow past passage 110, gate 112 operates to draw particles into and through the passage to be collected or further transported or sorted in chamber 114. The gate can be configured and adjusted to draw particles having pre-determined characteristics from the low agglomeration of the particle cloud into and through the passage, as will be discussed in further detail hereinafter. Thus, the system can selectively sort particles, as the same are transported along the channel.

Figure 6:
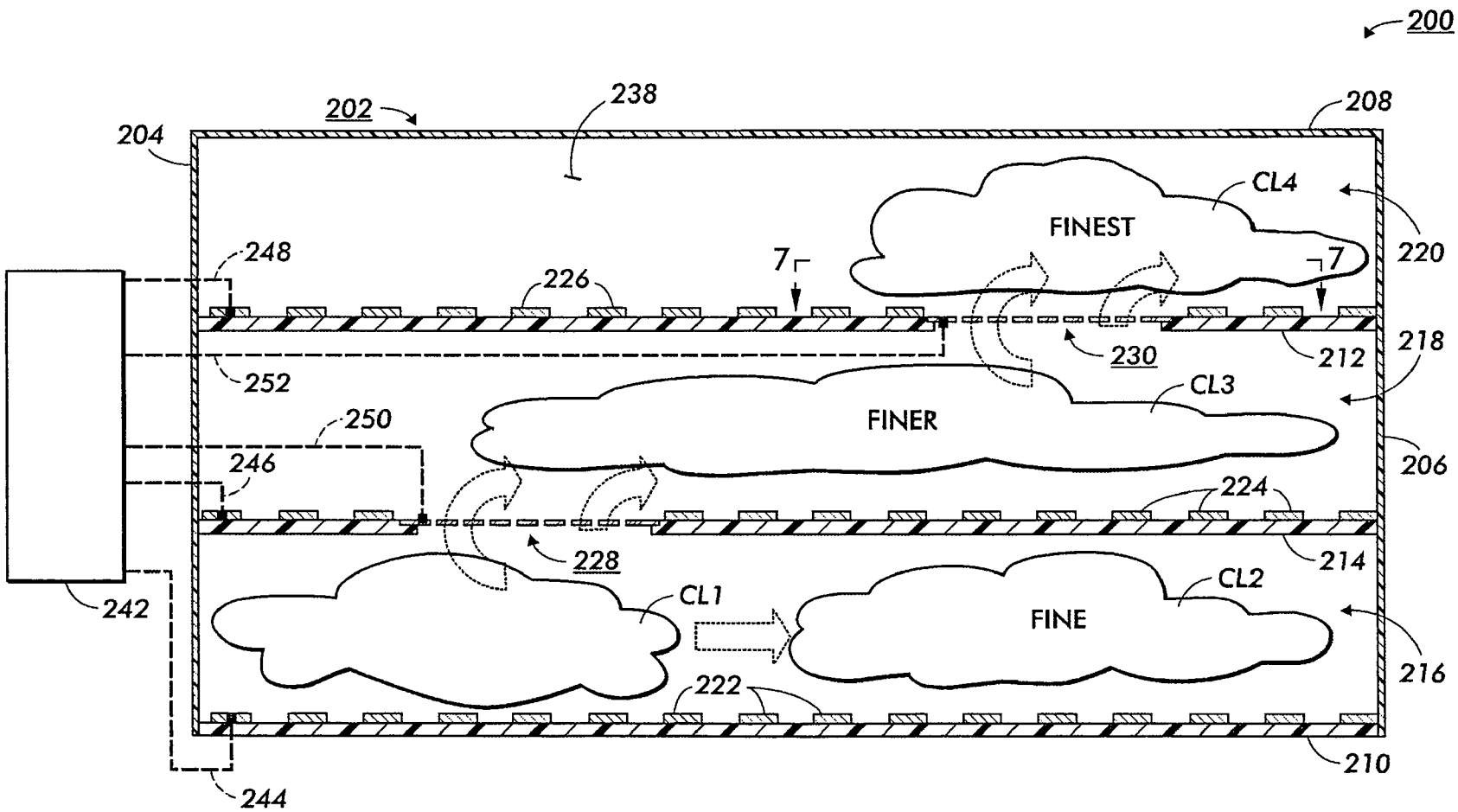
FIG. 6 is a side elevation view of another embodiment of a system in accordance with the present invention having a plurality of transport channels and gating passages and shown transporting and selectively sorting particles.

Another embodiment of a system 200 for transporting and selectively sorting particles is shown in FIG. 6. System 200 includes a housing 202 having end walls 204 and 206, a top wall 208 and a bottom wall 210 each extending between the end walls. Intermediate walls 212 and 214 extend between end walls 204 and 206, and are shown as being substantially parallel with one another and to the top and bottom walls. However, it is to be specifically understood that other configurations can be used without departing from the scope and intent of the present invention. A first transport channel 216 extends between walls 210 and 214. Similarly, a second transport channel 218 extends between walls 212 and 214, and a third transport channel 220 extends between walls 208 and 212. A traveling wave grid can be used within one or more of the transport channels. As shown in FIG. 6, traveling wave grids 222, 224 and 226 are each disposed along the bottom wall of each of the channels. Additionally, one or more passages are provided through each of intermediate walls 212 and 214, such that all three transport channels are in fluid communication with one another.

Figure 7:
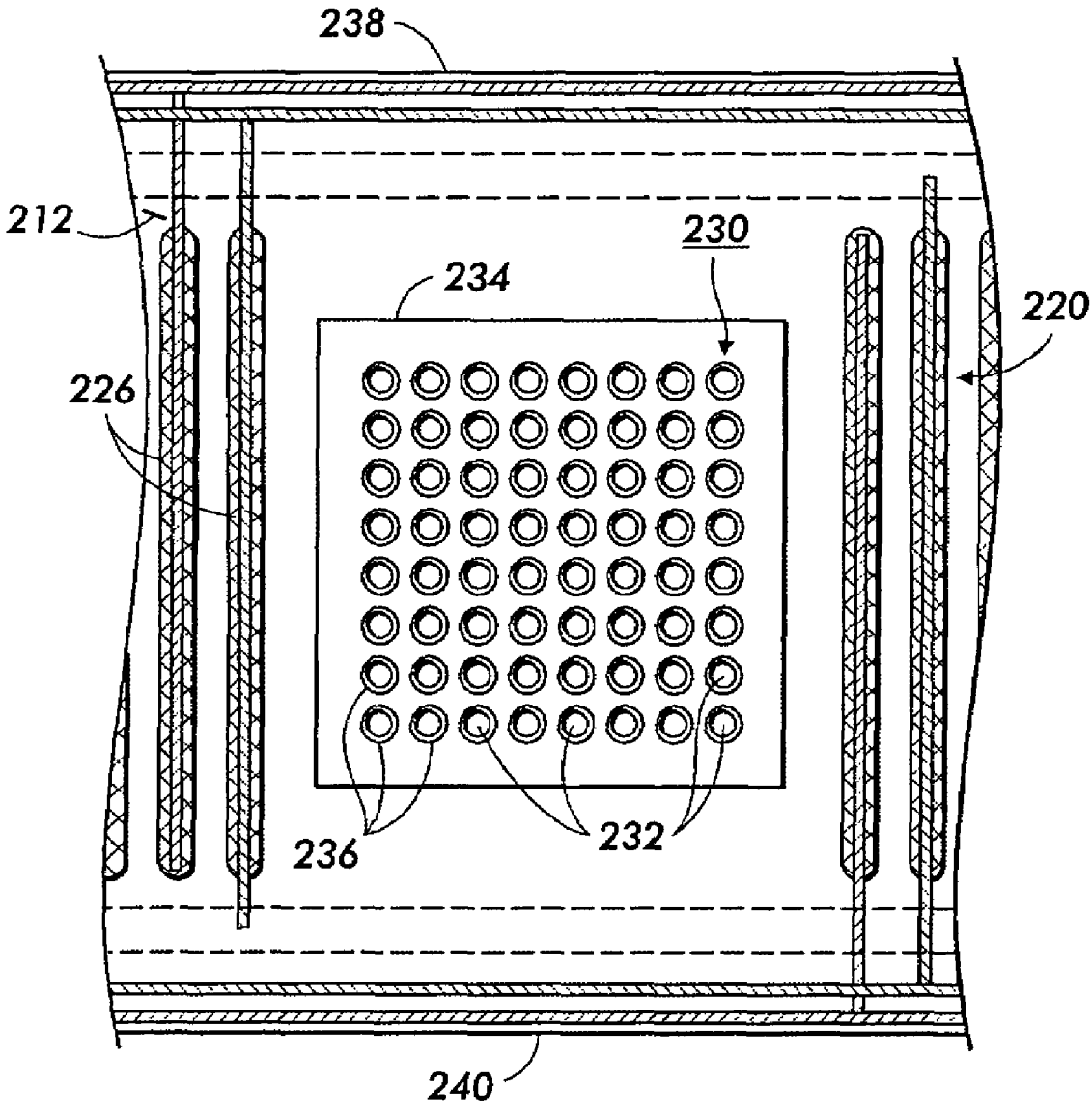
FIG. 7 is a top plan view of one embodiment of a uniform array of passages having operatively associated gates in accordance with the present invention shown disposed along a channel wall.

In the embodiment shown in FIG. 6, the passages take the form of aperture arrays 228 and 230 supported on intermediate walls 212 and 214, respectively. The aperture arrays can take any suitable form, arrangement or configuration, including uniform and/or non-uniform aperture patterns, as desired. One example of a suitable array is shown in FIG. 7 and includes a uniform, 8×8 pattern of apertures 232 defined on a passage member 234 that is supported on or along wall 212 of channel 220. The apertures can be of any suitable size, shape or configuration. For example, apertures 232 can be cylindrical and have a diameter of from about 10 μm to about 250 μm. A gate 236 of suitable size and dimension is disposed along each aperture 232. A similar gating arrangement can be provided on aperture array 228 (FIG. 6). The housing, in this or other embodiments, can optionally include side walls 238 and 240 further defining the channels therein, as shown in FIG. 7.

System 200 also includes a power supply 242. Connectors 244, 246 and 248 extend in electrical communication from the power supply to traveling wave grids 222, 224 and 226, respectively. Additionally, connectors 250 and 252 extend in electrical communication from power supply 242 to the gates operatively associated with aperture arrays 228 and 230, respectively. It will be appreciated that the power supply, traveling wave grids and gates can operate in a manner substantially identical to the multi-phase manner shown in and described with regard to power supply 116, traveling wave grids 108 and gates 112 of FIGS. 1-5. As such, further detail regarding the electrical configuration and operation of this embodiment is not reiterated here.

In operation, an initial particle cloud CL1 is provided within transport channel 216 adjacent end wall 204. In the embodiment shown in FIG. 6, system 200 transports cloud CL1 from one end of housing 202 to the other end. In the process of transporting the particles, the particles of cloud CL1 are sorted into three relative size ranges indicated as fine particle cloud CL2, finer particle cloud CL3 and finest particle cloud CL4. It will be appreciated that cloud CL1 is substantially similar to particle cloud PC shown in FIG. 1, and can includes particles that can be categorized in one of three different size ranges, generally labeled fine particles, finer particles and finest particles for convenience and readability. It will be appreciated that the size ranges can be any suitable size ranges, as desired. In an example of one embodiment, the size ranges could include fine particles having a dimension of from about 7 μm to about 10 μ, the finer particles having a dimension of from about 4 μm to about 6.9 μm, and the finest particles having a dimension of from about 1 μm to about 3.9 μm. In another example of an embodiment, the size ranges could include fine particles having a dimension of from about 20 μm to about 30 μm, the finer particles having a dimension of from about 10 μm to about 19 μm, and the finest particles having a dimension of from about 1 μm to about 9 μm. Additionally, the particles forming the initial particle cloud can have varying electrical charge magnitudes and/or differing electrical charge polarities. As an example, the particles could include a first population of particles having either a positive or negative electrical charge with a magnitude in the range of from about 15 fC to about 25 fC, another population of particles having either a positive or negative electrical charge with a magnitude in the range of about 8 fC to about 14 fC, and still another population of particles having either a positive or negative electrical charge with a magnitude in the range of about 1 fC to about 7 fC. It is to be specifically understood, that the foregoing examples of ranges of particle size and electrical charge magnitude are simply examples of some of the characteristics and ranges of characteristics that can be used as a basis for sorting particles, and that the present invention is not intended to be in anyway limited or constrained by the foregoing examples.

Initial particle cloud CL1 is induced to flow along channel 216 in the hopping and surfing modes discussed above. As the particle cloud flows along the channel, a gradient develops across the cloud where the finest particles will move toward the top of the cloud and the larger particles will move toward the bottom of the cloud. As the initial particle cloud continues to travel along the channel, the gradient will substantially stabilize. Eventually, a stabilized particle cloud reaches aperture array 228 and a selective portion of the initial particle cloud is gated or otherwise urged into and through apertures 232 of the aperture array. The size and electrical configuration of gates 236 disposed along each of the apertures can be optimized to gate particles within or below a pre-determined size range, as will be discussed hereinafter. As a result, a particle cloud CL2 having particles primarily in the fine range is transported along channel 216 for further processing, finer sorting or any other desired use. Also, a new particle cloud CL3 is formed in channel 218 that primarily includes particles in the finer and finest ranges. As particle cloud CL3 is urged along channel 218 by electrostatic traveling waves from grid 224, a stable size gradient once again develops across particle cloud CL3. Upon reaching aperture array 230, a selective portion of particle cloud CL3 is gated or otherwise urged into and through apertures 232 of aperture array 230. Once again, the size and electrical configuration of the gates disposed along each of the apertures can be optimized to gate particles within or below a pre-determined size range into channel 220 to form particle cloud CL4. The remainder of particle cloud CL3, now primarily formed of particles in the fine range, can be delivered along channel 218 for further processing, additional sorting or any other desired use. Similarly, particle cloud CL4 can be delivered along channel 220 for further processing, additional sorting or other uses. It will be appreciated that a system in accordance with the present invention can take any suitable shape, configuration or arrangement, and can include any number of channels and aperture arrays as desired to suitably transport and sort particles.

Figure 8:
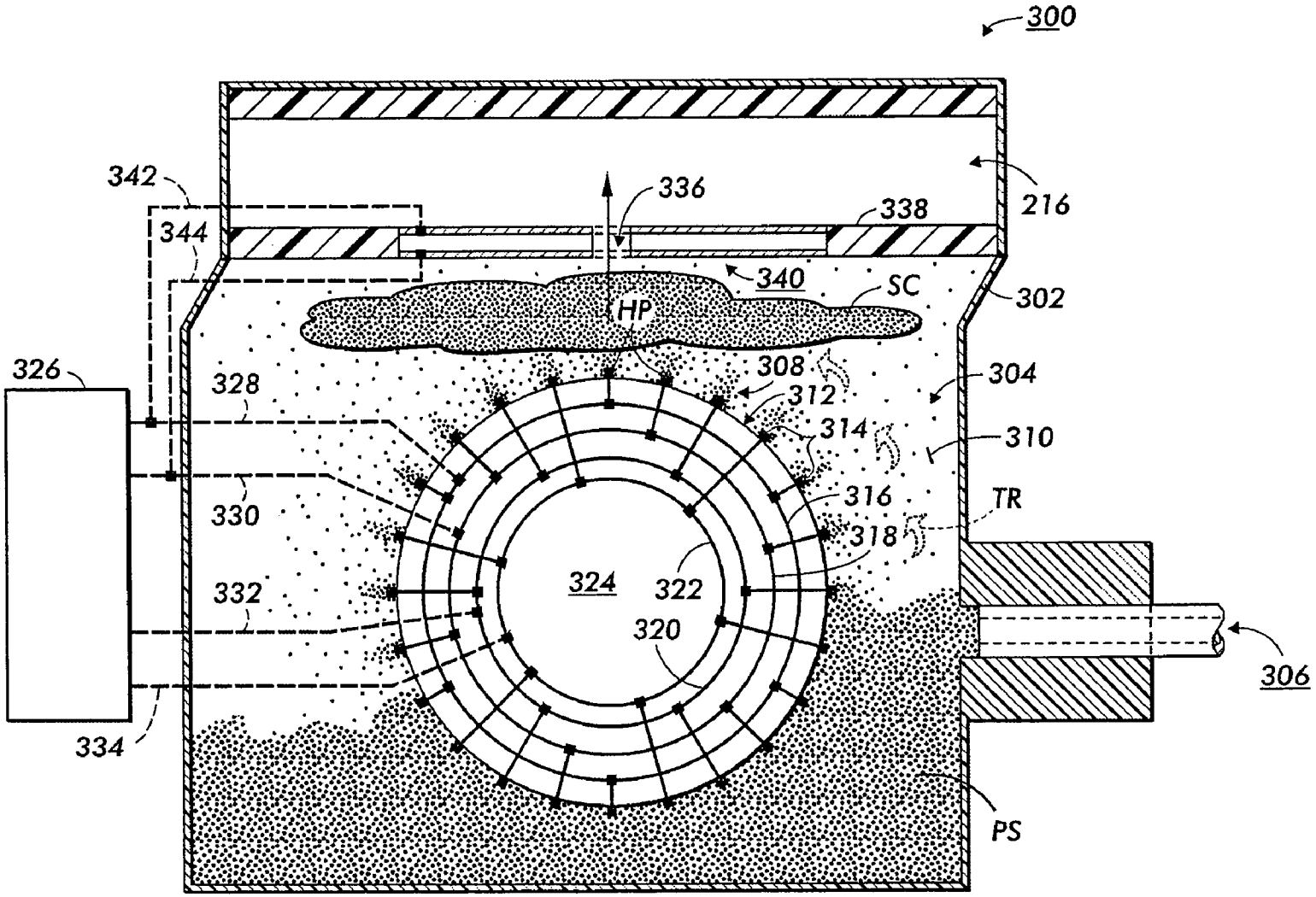
FIG. 8 is a side elevation view of still another embodiment of a system in accordance with the present invention with a traveling wave grid and a gating passage.
Figure 9:
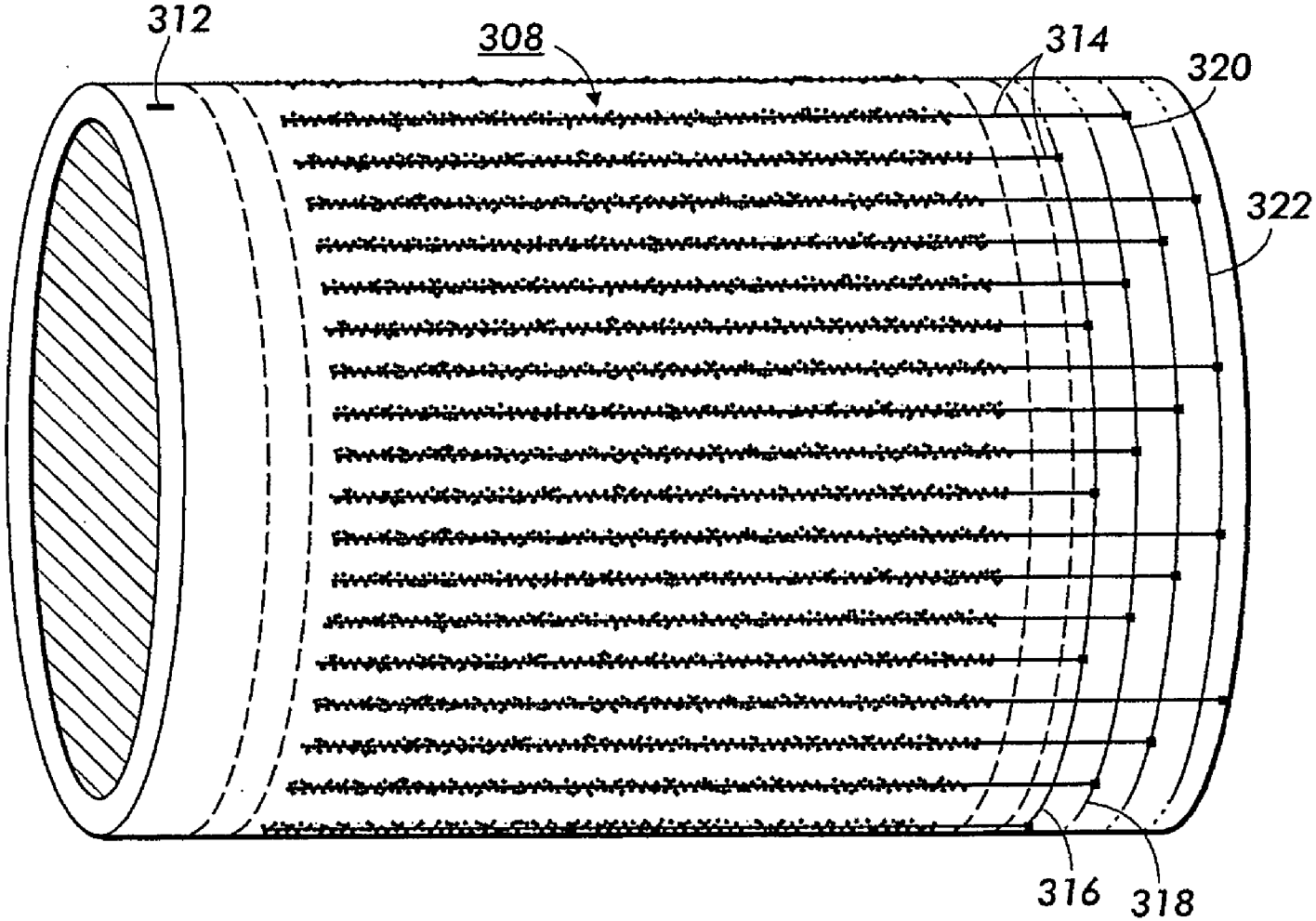
FIG. 9 is a perspective view of the support member and traveling wave grid of FIG. 8 shown with particles aligned along the traveling wave grid during transport.

Another embodiment of a system 300 for transporting and selectively sorting particles is shown in FIGS. 8 and 9. System 300 includes a supply housing 302 at least partially defining a supply chamber 304. The supply chamber contains a supply of particles PS to be transported and selectively sorted. A supply conveyor 306, of any suitable type or arrangement, is provided to replenish particle supply PS as needed. A traveling wave grid 308 is disposed within supply chamber 304, and is supported on an external wall 310 of a support member 312. The support member is shown in FIG. 8 as being a substantially cylindrical, solid rod. It will be appreciated, however, that any suitable support member can be used, including non-cylindrical and/or hollow wall support members.

It will be appreciated that traveling wave grid 308 is substantially similar to the traveling wave grids discussed hereinbefore, and is formed from a plurality of conductors 314. In FIG. 8, the conductors are arranged as inter-digitized conductor groups 316, 318, 320 and 322. Portions of the conductor groups are shown in FIG. 8 as being arranged in concentric circles on an end wall 324 of the support member. However, it will be appreciated that any suitable arrangement can be used, including providing a portion of one or more conductor groups along external wall 310 of support member 312, as shown in FIG. 9.

System 300 also includes a power supply 326 adapted to output a multi-phase electrical signal, as discussed in detail hereinbefore. Power supply 326 is in electrical communication with conductor groups 316, 318, 320 and 322 through connectors 328, 330, 332 and 334, respectively. A passage 336 is provided through top wall 338 of housing 302, and includes a gate 340 suitable for enabling selective particle migration through the passage. The gate is in electrical communication with power supply 326 through connectors 342 and 344. It will be appreciated that the power supply, traveling wave grids and gates can operate in a manner substantially identical to the multi-phase manner shown in and described with regard to power supply 116, traveling wave grids 108 and gates 112 of FIGS. 1-5. As such, further detail regarding the electrical configuration and operation of this embodiment is not reiterated here.

In operation, system 300 can transport and selectively sort particles PS as discussed hereinbefore. In the embodiment shown in FIG. 8, the system can provide these particles to another chamber, cavity or channel, such as channel 216 of system 200, for example, shown adjacent passage 336. In such an arrangement, system 300 can act as a supply apparatus for generating the initial particle cloud CL1, shown in FIG. 6, for example. System 300 can selectively gate particles from supply cloud SC through the passage and into channel 216, for example.

Figure 10:
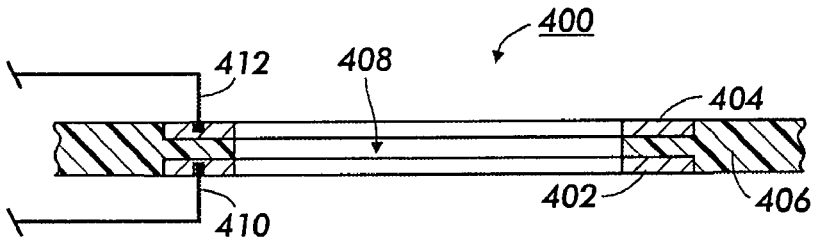
FIG. 10 is a side elevation view, shown in cross-section, of one embodiment of a gate in accordance with the present invention.

As an electrostatic traveling wave is driven around external wall 310 of support member 312 by traveling wave grid 308, particles HP closest to the conductors jump or hop along from conductor to conductor in a synchronous manner as discussed hereinbefore around external wall 310 of support member 312 as indicated by arrow TR. Surfing particles (not numbered) will follow the hopping particles along the traveling wave grid, as discussed above, and can provide low agglomeration particles to form supply cloud SC. Alternately, the supply member can be supported a suitable distance from passage 336 for gate 340 to deliver particles in hopping mode through the passage. An illustration of particle alignment along conductors 314, which extend from conductor groups 316, 318, 320 and 322, is shown in FIG. 9, Various embodiments of suitable gate structures in accordance with the present invention are shown in FIGS. 10, 10A, 10B and 10C. A gate 400 is shown in FIG. 10 as having first and second electrodes 402 and 404 that are each recessed into a wall 406 along a passage 408 extending therethrough. The electrodes are disposed in spaced relation to one another, and form opposing end portions of passage 408. First electrode 402 is connected to a suitable multi-phase electrical source (not shown) through connector 410, and second electrode 404 is similarly connected through connector 412.

Figure 10A:
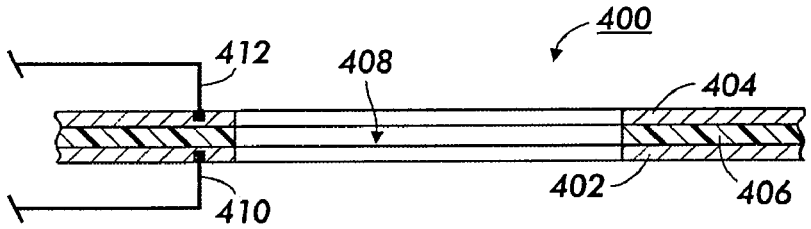
FIG. 10A is a side elevation view, shown in cross-section, of another embodiment of a gate in accordance with the present invention.

As shown in FIG. 10A, another embodiment of gate 400 is formed from first and second electrodes 402 and 404. In this embodiment, the electrodes take the form of an elongated strip or sheet, and are disposed in spaced relation to one another with wall 406 positioned therebetween. The electrodes form opposing end portions of passage 408, which extends through both of the electrodes as well as wall 406. As discussed above, first electrode 402 is connected to a suitable multi-phase electrical source (not shown) through connector 410 and second electrode 404 is similarly connected through connector 412. One example of a suitable construction of such an embodiment can include wall 406 formed from a suitable dielectric material, such as about 10 μm thick to about 100 μm thick KAPTON film, for example. Both sides of the film can be coated with a conductive metallic layer, such as a layer of gold, for example.

Figure 10B:
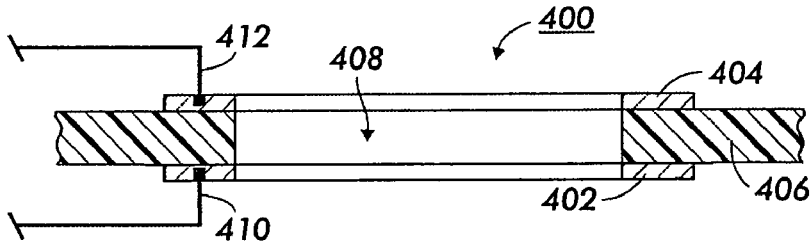
FIG. 10B is a side elevation view, shown in cross-section, of still another embodiment of a gate in accordance with the present invention.

Still another embodiment of gate 400 is shown in FIG. 10B. It will be appreciated that this embodiment is substantially similar to the embodiment shown in and described with regard to FIG. 10. However, in the embodiment shown in FIG. 10B, electrodes 402 and 404 are supported on wall 406 and not recessed there into. Electrodes 402 and 404 still form opposing end portions of passage 408.

Figure 10C:
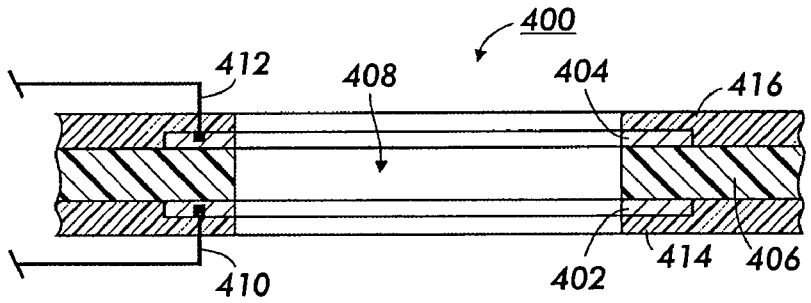
FIG. 10C is a side elevation view, shown in cross-section, of yet another embodiment of a gate in accordance with the present invention.

A further embodiment of gate 400 is shown in FIG. 10C, and is substantially similar to that shown in FIG. 10B. However, the embodiment shown in FIG. 10C includes additional layers 414 and 416 disposed along both sides of wall 406 and respectively over electrodes 402 and 404. It will be appreciated that layers 414 and 416 form opposing end portions of passage 408, rather than the electrodes as in other embodiments.

The gates discussed herein can be formed from any suitable materials. For example, the electrodes can be formed from conductive metals, such as gold, silver or copper. Additionally, the wall disposed between the electrodes can be any suitable electrically insulating material, such as suitable fluoropolymers and/or polyimides, for example. One suitable polyimide is KAPTON, and suitable grades of fluoropolymers are sold under the trademark TEFLON by DuPont Teflon of Wilmington, Del. Additionally, layers 414 and 416 can be formed from any material suitable to meet the desired purpose of the layers. For example, where the layers are intended to facilitate cleaning, the layers could be formed from a suitable TEFLON compound or other reduced-friction material.

Figure 11:
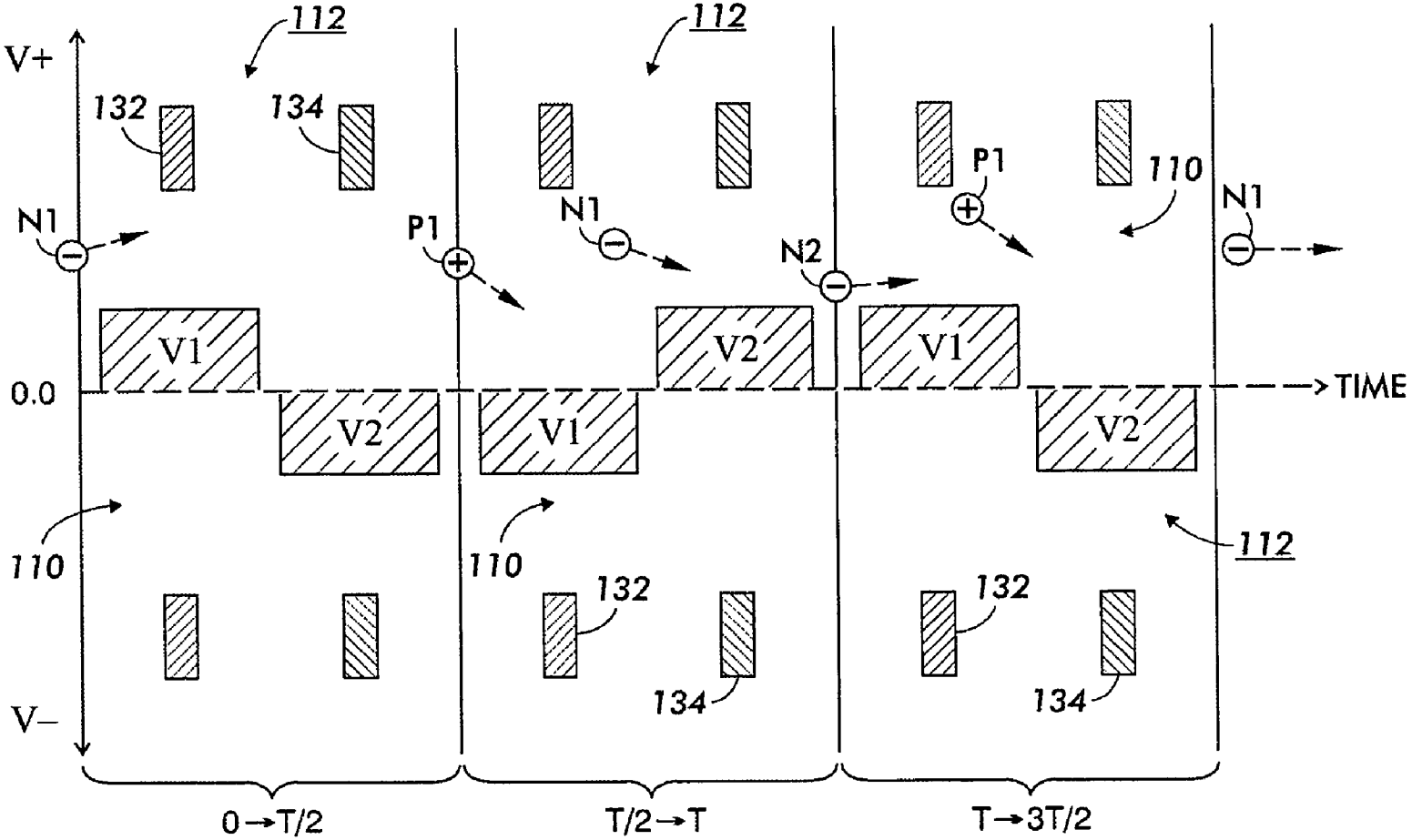
FIG. 11 is a voltage pattern suitable for gating bipolar particles using a bipolar voltage signal.
Figure 12:
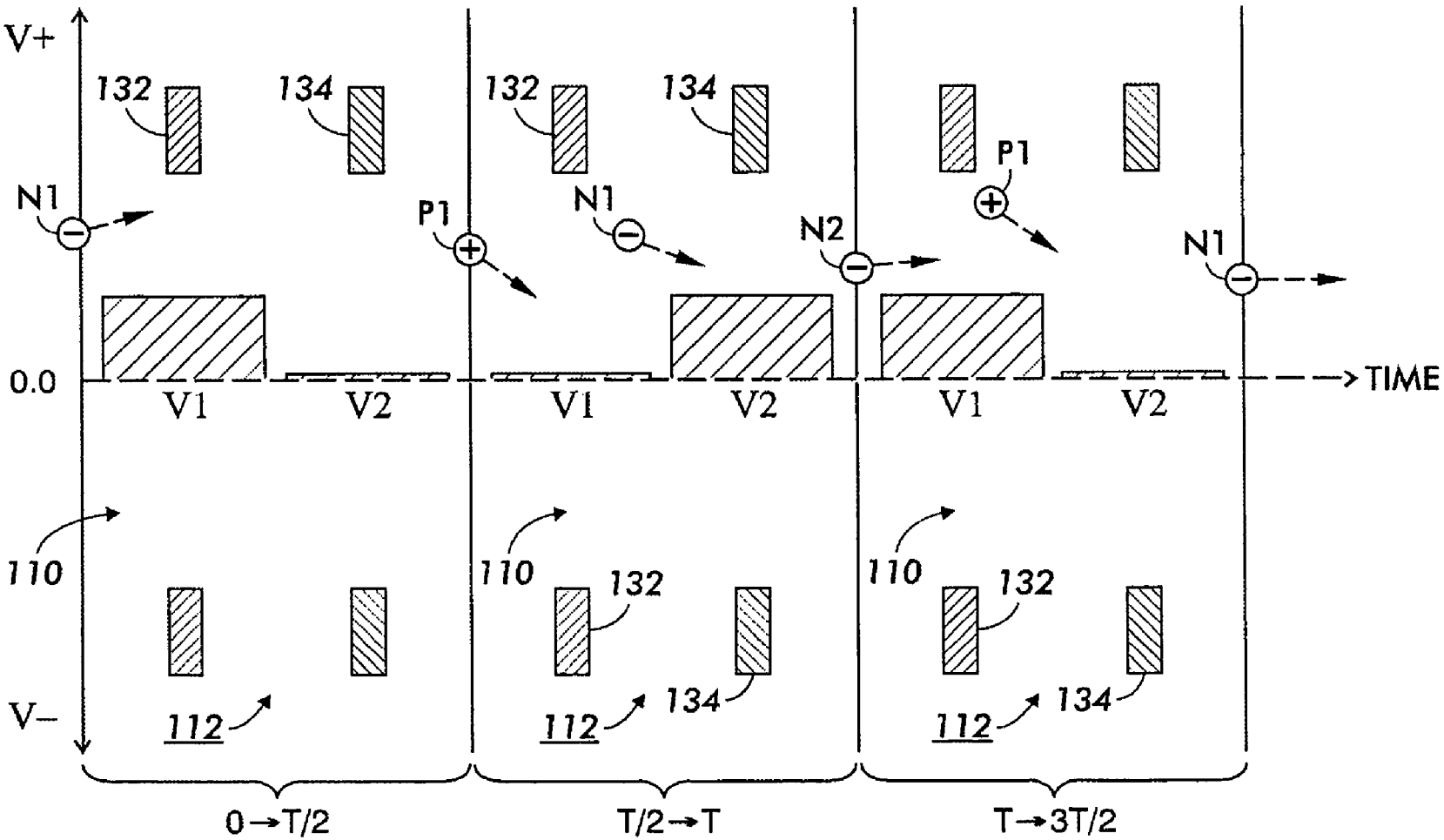
FIG. 12 is a voltage pattern suitable for gating bipolar particles using a unipolar voltage signal.

Gates in accordance with the present invention can operate to urge selected particles through an associated passage in any suitable manner. One example of a suitable manner is illustrated in FIGS. 11-15, and can be applied, for example, to gate 112 in FIG. 1. The voltage patterns shown in FIGS. 11 and 12 illustrate the polarity and relative magnitude for voltages V1 and V2 from time zero to T/2, then from time T/2 to T, then from time T to 3T/2. It will be appreciated that such voltage patterns can be used for any number of time cycles and/or portions of time cycles without departing from the scope and intent of the present invention. For purposes of illustration, voltage V1 can be considered to be applied across electrode 132 of gate 112 and voltage V2 can be considered to be applied across electrode 134. Additionally, it will be appreciated that particles N1, N2 and P1 move from voltage V1 toward voltage V2 for each time period just as one or more particles would move from outside passage 110 adjacent electrode 132 to inside passage 110 between the electrodes and thereafter to outside the passage adjacent electrode 134.

In operation, negatively charged particle N1 is outside passage 110 but sufficiently near electrode 132, which is positively charged at voltage V1, to be drawn toward the same and into passage 110 as shown at time zero to T/2. Electrode 134 is negatively charged at voltage V2 at time zero to T/2. It will be appreciated from FIG. 11 that the voltages applied across electrodes 132 and 134 are 180 degrees out of phase. That is, when one electrode is negatively charged the other is positively charged. As such, the gate alternately urges negatively charged particles into the passage and then positively charged particles into the passage.

At time T/2 to T, voltage V1 of electrode 132 has changed to negative and voltage V2 of electrode 134 has changed to positive. Additionally, positively charged particle P1 is sufficiently close to now negatively charged electrode 132 that the particle is drawn toward the electrode and into passage 110. During this same time, now positively charged electrode 134 draws negatively charged particle N1 through the passage, while positively charged electrode 132 repulses particle N1 through the passage toward electrode 134.

At time T to 3T/2, voltage V1 of electrode 132 has returned to positive and voltage V2 of electrode 134 has returned to negative. A new negatively charged particle N2 is now sufficiently close to positively charged electrode 132 to be drawn toward the electrode and into the passage. Positively charged particle P1 positioned between the electrodes is urged away from positively charged electrode 132 and toward negatively charged electrode 134, thus moving particle P1 through the passage. Additionally, particle N1 has passed out of the passage and is urged away therefrom and into the associated chamber, cavity or channel by now negatively charged electrode 134.

One advantage of the foregoing arrangement is that both positively and negatively charged particles are gated. This tends to maximize the throughput of the gating arrangement, leading to high-speed and efficient delivery of particles into the associated channel, chamber or cavity. As an example, a 50 μm diameter aperture has been shown to be capable of gating 50 μg/s of material from a particle cloud of about 2.4 percent particles in air by volume, with the gate operating at 400 V and 1 kHz. This translates into gating material at about 5 mg/s from a 10×10 array of 50 μm apertures. Located on about 100 μm centers, such an array would have a footprint of only about 1 mm by 1 mm.

Figure 13:
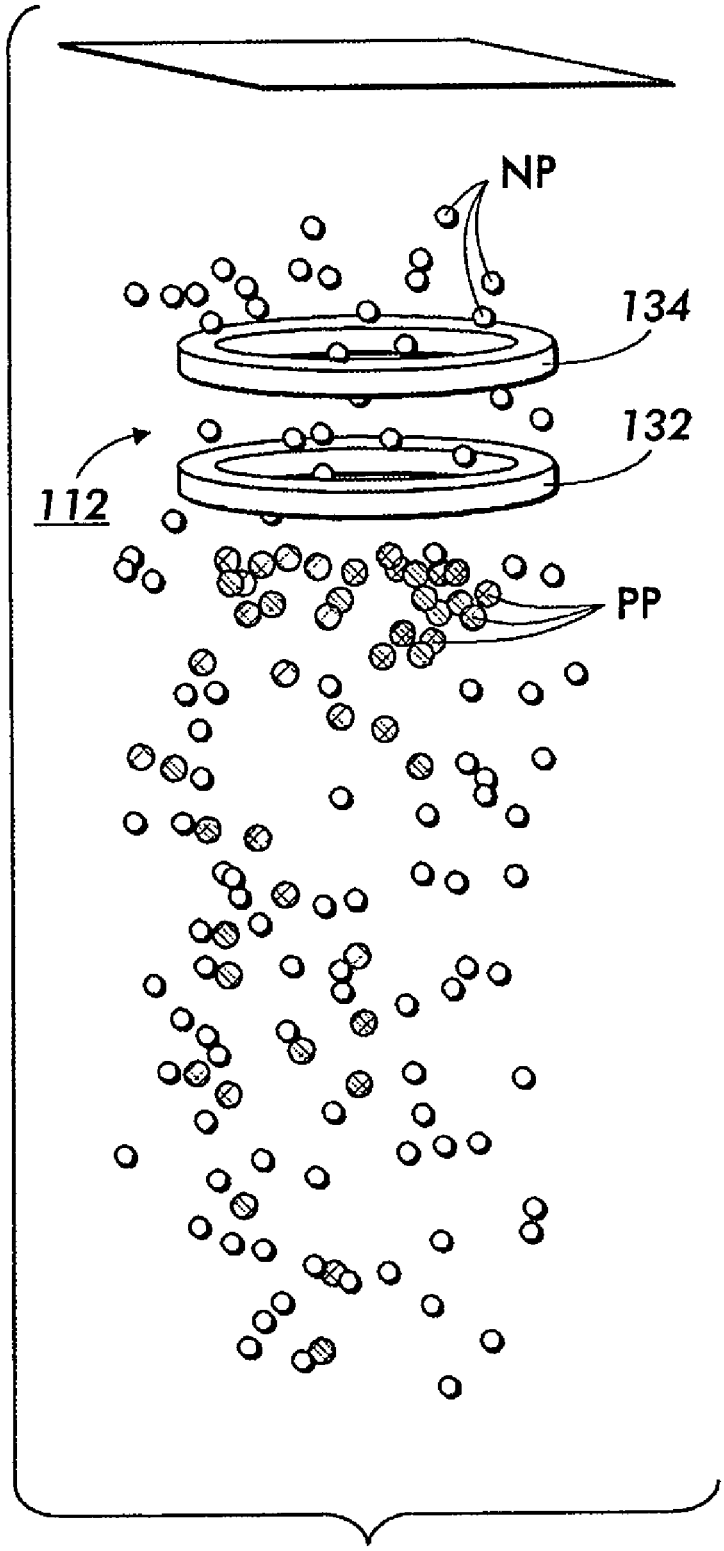
FIG. 13 is a perspective view of one embodiment of a gate in accordance with the present invention shown gating particles having a first common characteristic.
Figure 14:
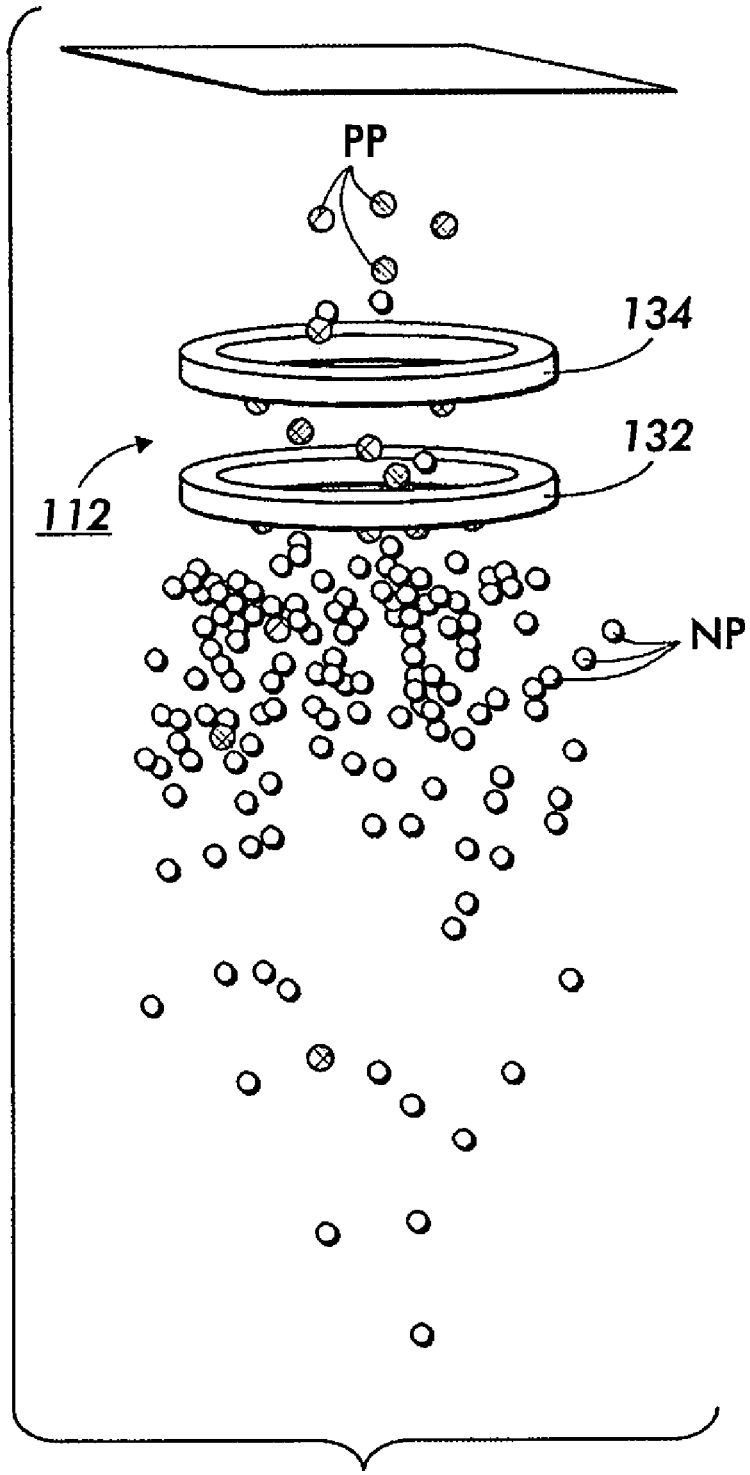
FIG. 14 is a perspective view of the gate in FIG. 13 shown gating particles having a second, different common characteristic.
Figure 15:
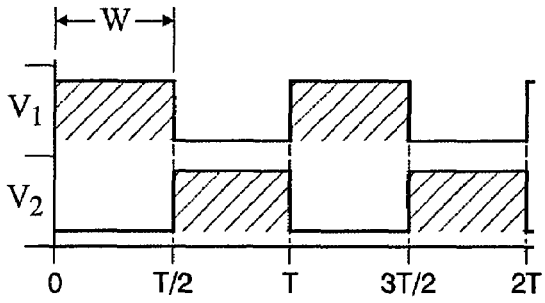
FIG. 15 is a voltage pattern illustrating a duty cycle of a 2-phase voltage signal suitable for operating a gate in accordance with the present invention.

As shown in FIG. 12, gate 112 can also operate in the foregoing manner using a unipolar voltage pattern, rather than by using the bipolar voltage pattern shown in FIG. 11. FIGS. 13 and 14 are snapshots of computer animation that illustrate the alternating manner in which a gate, such as gate 112, operates using a voltage pattern, such as that shown in and described with regard to FIGS. 11 and 12. In FIG. 13, electrode 132 is positively charged and electrode 134 is negatively charged. As such, positively charged particles PP are repelled by electrode 132 and prevented from entering the passage, while negatively charged particles NP are gated into the passage. In FIG. 14, the polarity of each electrode has changed and positively charged particles PP are gated while negatively charged particles NP are repelled. FIG. 15 illustrates the duty cycle W of voltages V1 and V2 during the use of a unipolar voltage pattern, such as that shown in FIG. 12.

Figure 16:
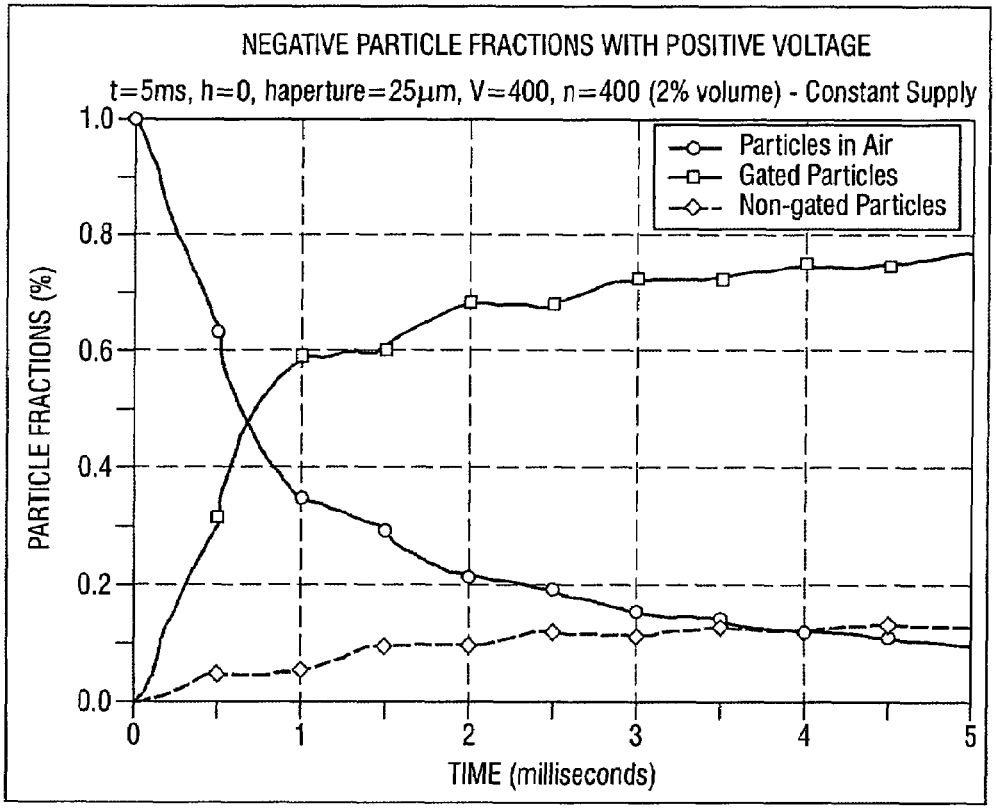
FIG. 16 is a graph of fractions of gated and non-gated negative particles as a function of time using positive voltage.
Figure 17:
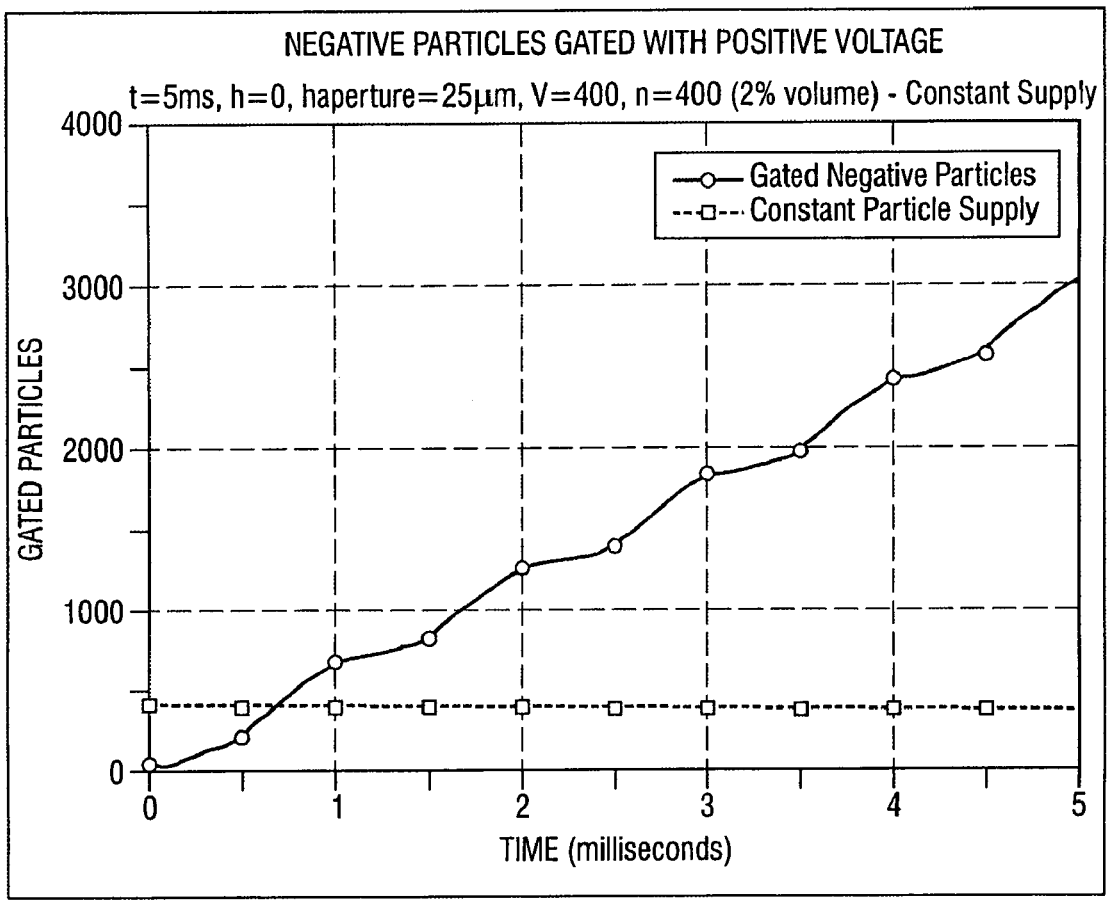
FIG. 17 is a graph of negative particles gated as a function of time using positive voltage.

FIG. 16 is a graph of negative particle fractions gated with positive voltage versus time. The results were obtained from conditions in which a constant supply of 400 particles in air at 2 percent by volume were gated through an aperture having a 25 μm radius with a +400V applied thereacross. The total particles in the air are shown by a solid line with circle symbols. The number of gated particles are shown by a solid line with square symbols, and the number of non-gated particles are shown by a dashed line with diamond symbols. It will be appreciated that one manner of interpreting FIG. 16 is that the curve showing the number of gated particles can be indicative of gating efficiency or effectiveness. In FIG. 16, about 78 percent of the particles are gated after 5 ms. However, 90 percent to 95 percent, or possibly an even greater percentage, of the particles could be gated under optimized conditions and parameters. FIG. 17 is a graph of the number of negative particles gated with a positive voltage versus time. These results were obtained under the same conditions as described with regard to FIG. 16. The number of gated negative particles are shown as a solid line having circle symbols. A curve showing the particle supply is indicated by a dashed line with square symbols.

Figure 18:
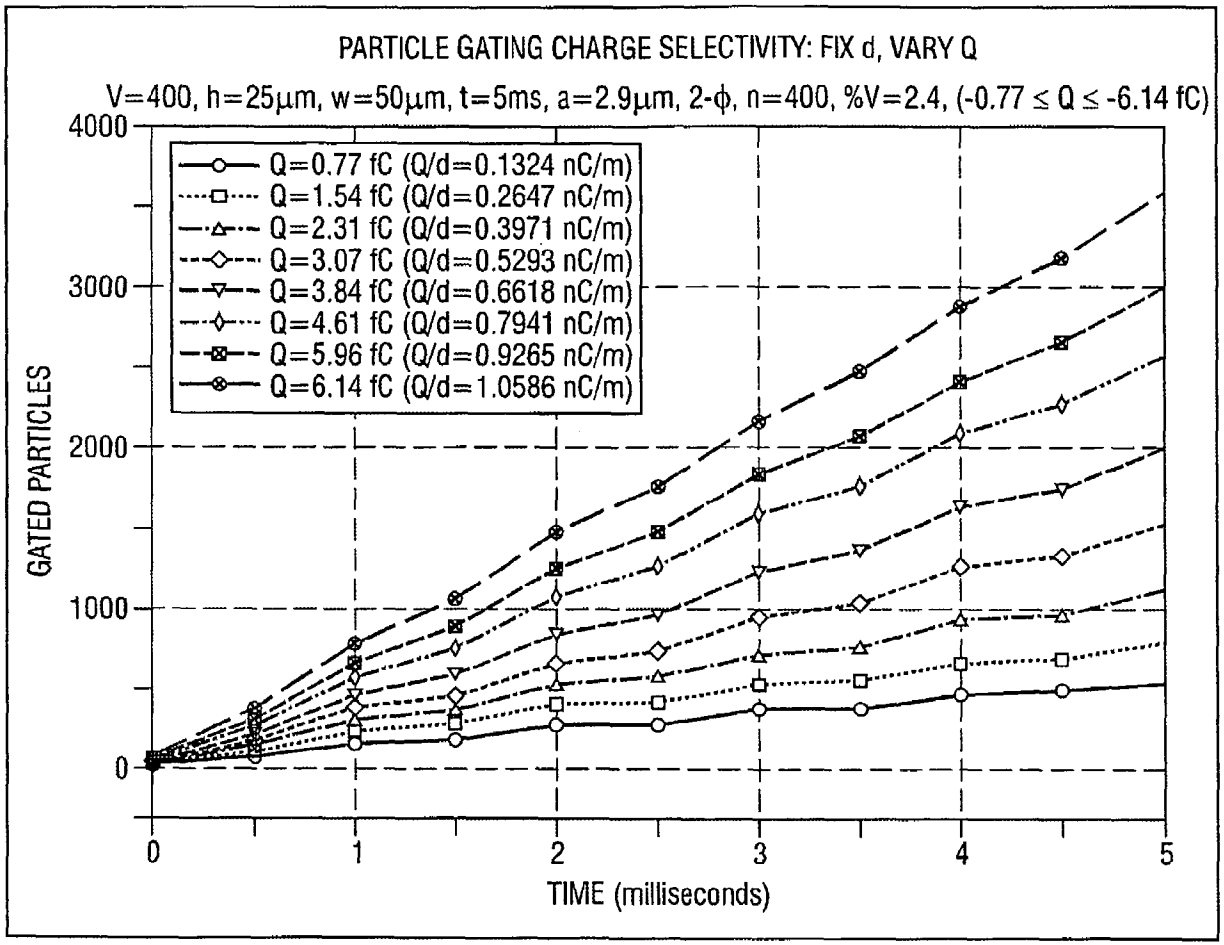
FIG. 18 is a graph of gated particles as a function of time as the charge magnitude of the particles is varied.

FIG. 18 is a graph of particles gated versus time for particles having various charge magnitudes. The results were obtained from conditions in which a constant supply of 400 particles in air at 2.4 percent by volume were provided. Generally, the particles had a radius of about 2.9 μm and were gated through a two-phase aperture having a 50 μm diameter with two electrodes spaced 25 μm apart. The gate operated at +400 V. A curve showing the gating of particles having a charge magnitude of −0.77 fC is shown by a solid line having circle symbols. A curve showing the gating of particles having a charge magnitude of −1.54 fC is shown by a dotted line having square symbols. A curve showing the gating of particles having a charge magnitude of −2.31 fC is shown by a dash-dot line having triangle symbols. A curve showing the gating of particles having a charge magnitude of −3.07 fC is shown by a dashed line having diamond symbols. A curve showing the gating of particles having a charge magnitude of −3.84 fC is shown by a dashed line having inverted triangle symbols. A curve showing the gating of particles having a charge magnitude of −4.61 fC is shown by a dash-dot-dot line having diamond symbols. A curve showing the gating of particles having a charge magnitude of −5.38 fC is shown by a dashed line having X-square symbols. A curve showing the gating of particles having a charge magnitude of −6.14 fC is shown by a dashed line having X-circle symbols.

Figure 19:
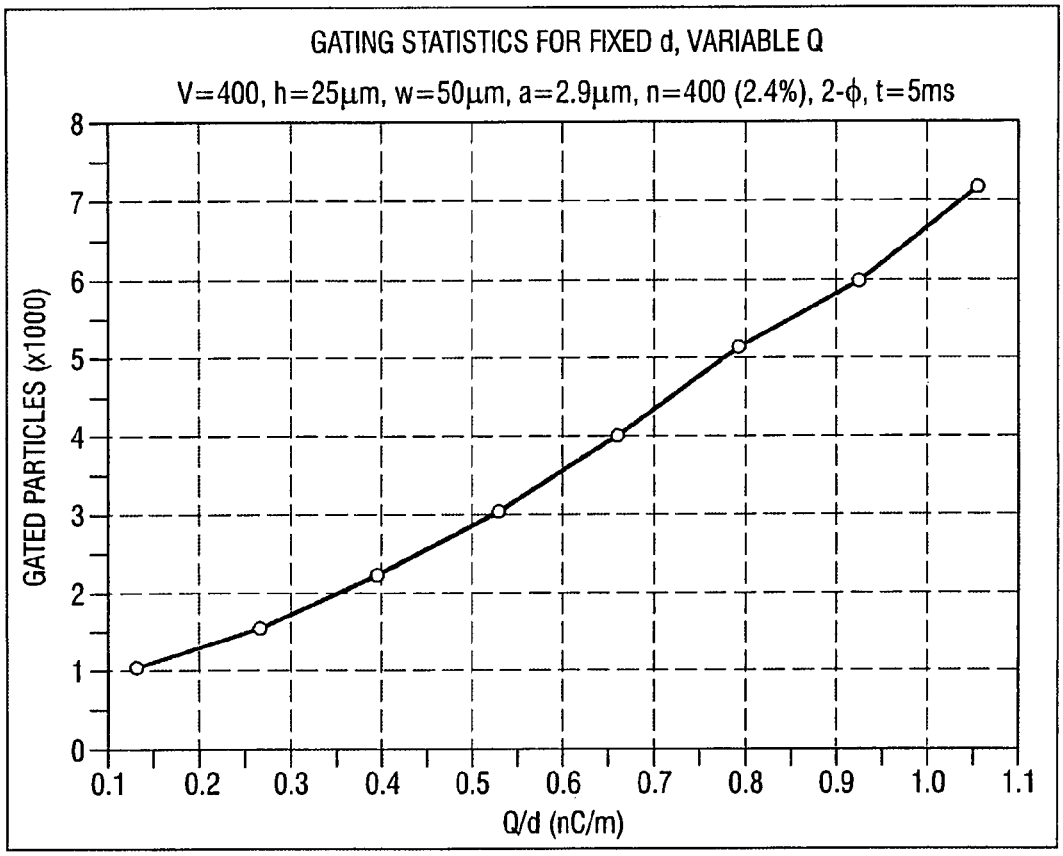
FIG. 19 is a graph of gated particles as a function of charge magnitude per diameter dimension, as the charge magnitude is increased as shown in FIG. 18.

FIG. 19 is a graph of gated particles versus charge per diameter dimension of the particles. The results of this chart were obtained under the same conditions as discussed in FIG. 18 with regard to the quantity of gated particles at a time of 5 ms. A curve showing the gated particles as a function of charge per diameter dimension is indicated by the solid line. As such, it will be appreciated that the number of gated particles increases as the magnitude of the charge on the particles increases. It will be appreciated, therefore, that particles can be selectively gated by optimizing the magnitude of the charge thereon.

Figure 20:
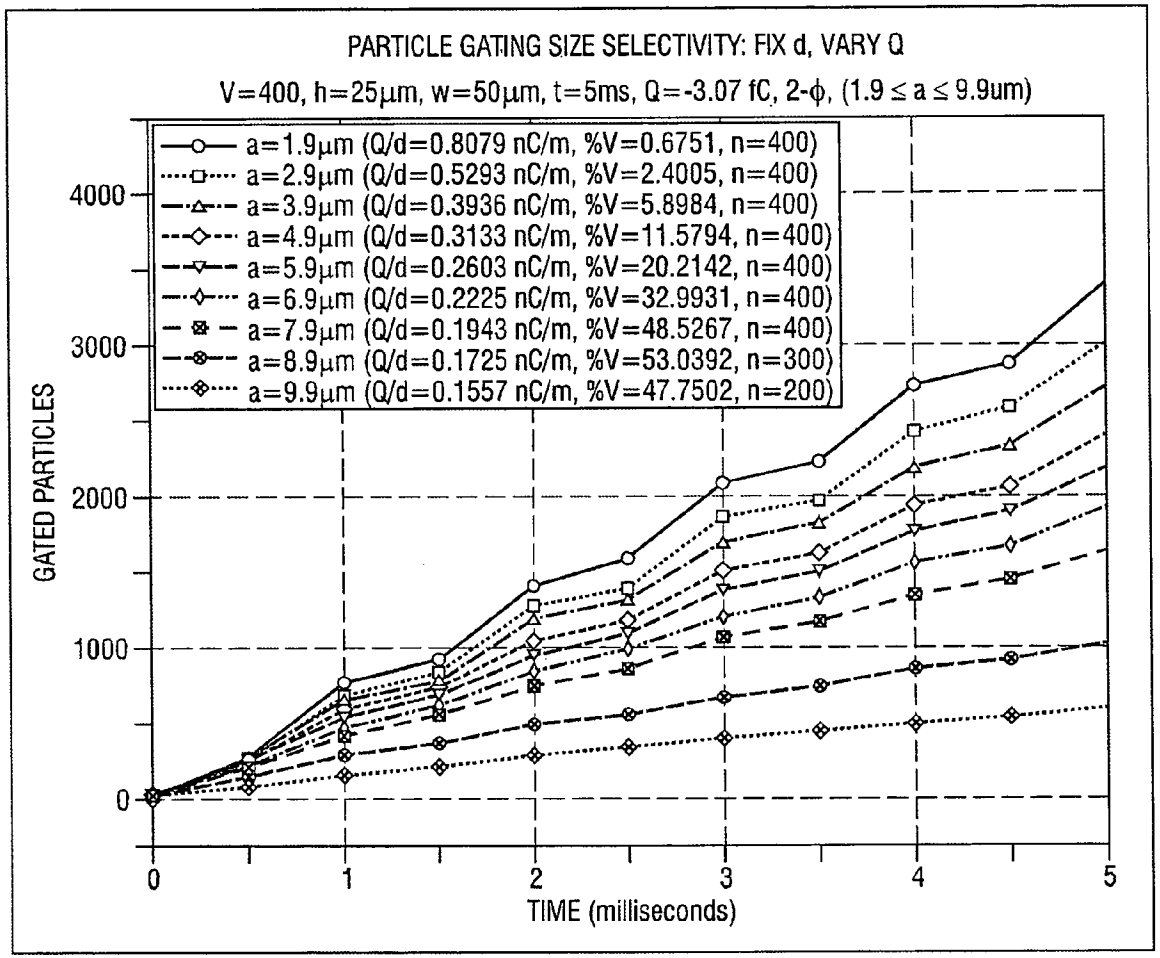
FIG. 20 is a graph of gated particles as a function of time as the diameter dimension of the particles is varied.

FIG. 20 is a graph of gated particles versus time for particles having a fixed charge magnitude and a varied diameter dimension. The results were obtained under conditions in which particles having varied sizes and a −3.07 fC charge magnitude were gated through a 50 μm diameter aperture. The two-phase gate included electrodes separated by 25 μm with a +400 V voltage applied across the electrodes. A curve of particles having a 1.9 μm radius is shown as a solid line with circle symbols. A curve of particles having a 2.9 μm radius is shown as a dotted line with square symbols. A curve of particles having a 3.9 μm radius is shown as a dash-dot line with triangle symbols. A curve of particles having a 4.9 μm radius is shown as a dashed line with diamond symbols. A curve of particles having a 5.9 μm radius is shown as a dashed line with inverted triangle symbols. A curve of particles having a 6.9 μm radius is shown as a dash-dot-dot line with diamond symbols. A curve of particles having a 7.9 μm radius is shown as a dashed line with X-square symbols. A curve of particles having a 8.9 μm radius is shown as a dashed line with X-circle symbols. A curve of particles having a 9.9 μm radius is shown as a dotted line with. X-diamond symbols.

Figure 21:
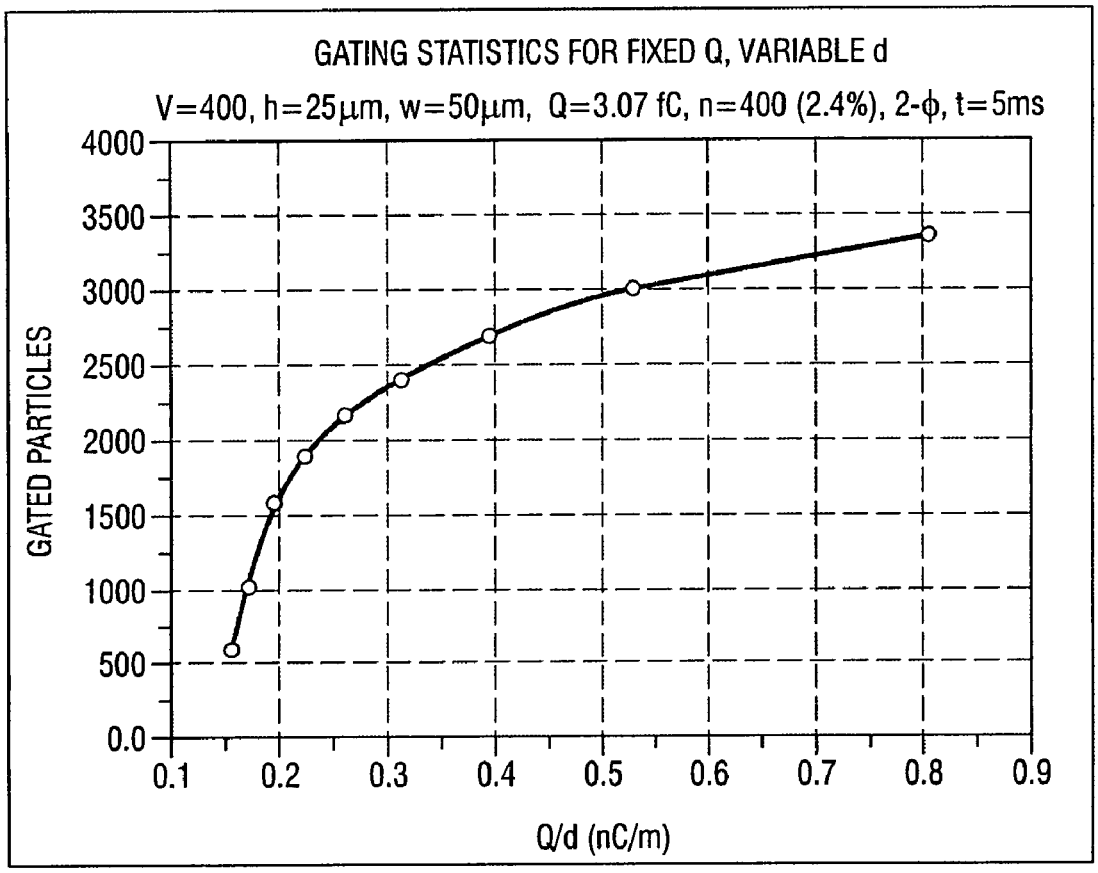
FIG. 21 is a graph of gated particles as a function of charge magnitude per diameter dimension, as the diameter is increased as shown in FIG. 20.

FIG. 21 is a graph of gated particles versus charge per diameter dimension where the charge is fixed and the diameter dimension is varied. The results were obtained under the same conditions as that for the results in FIG. 20. This graph is a plot of the number of gated particles at 5 ms for each of the curves shown in FIG. 20. It will be appreciated from FIG. 20 that the number of particles gated increases as the size of the particles decrease. As such, particles can be selectively gated by optimizing the aperture size and particle size. Additionally, other characteristics can be used, such as charge magnitude, for example, in the alternative or in combination to selectively gate particles.

Figure 22:
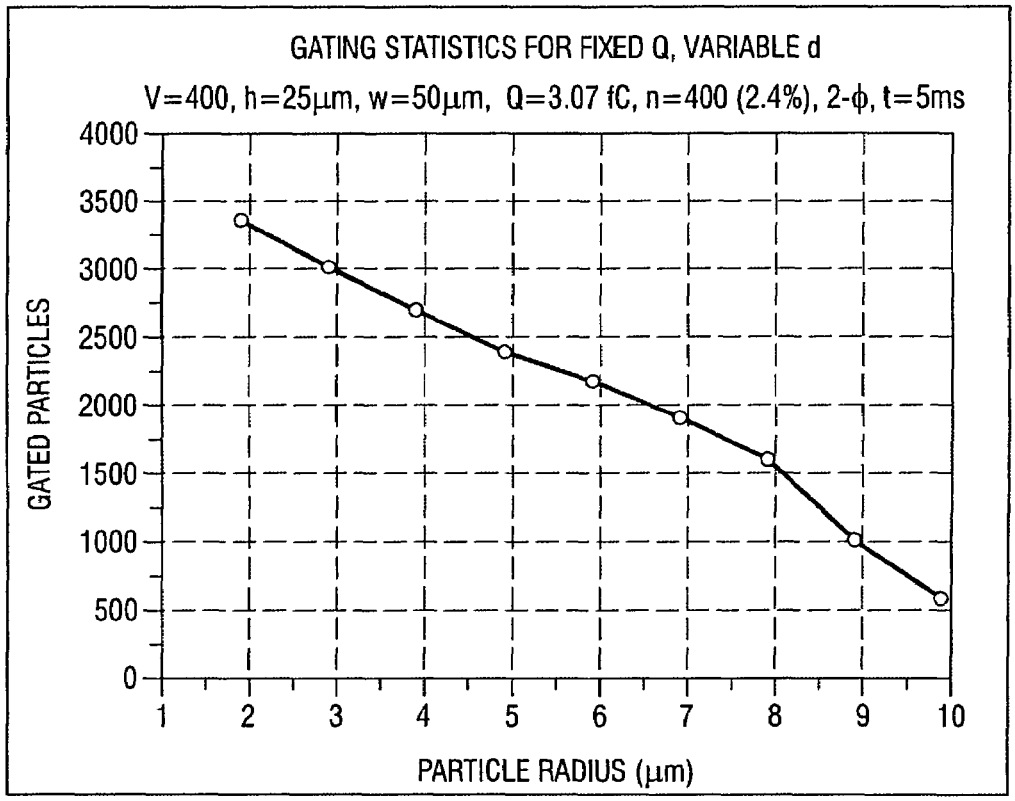
FIG. 22 is a graph of gated particles as a function of particle radius.

FIG. 22 is a graph of the number of gated particles versus particle radius. The results of this chart were obtained under the same conditions as FIGS. 20 and 21. The curve in FIG. 22 further illustrates that the number of particles gated increases as the size of the particles decreases.

Figure 23:
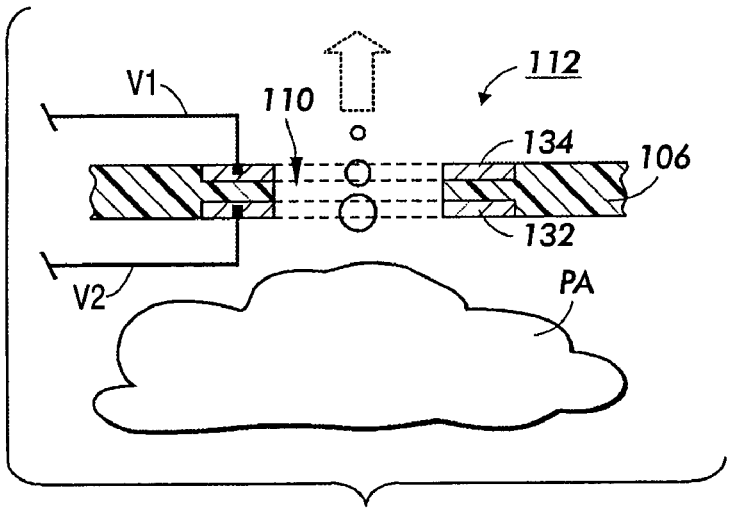
FIG. 23 schematically illustrates a gate in accordance with the present invention showing particles being gated therethrough.

FIG. 23 schematically illustrates particles from a particle cloud PA being urged through a passage, such as being gated through passage 110 by a gate 112 having electrodes 132 and 134. For the purposes of discussing FIGS. 24 and 25, electrode 132 has a voltage V2 applied thereacross, and electrode 134 has a voltage V1 applied thereacross.

Figure 24:
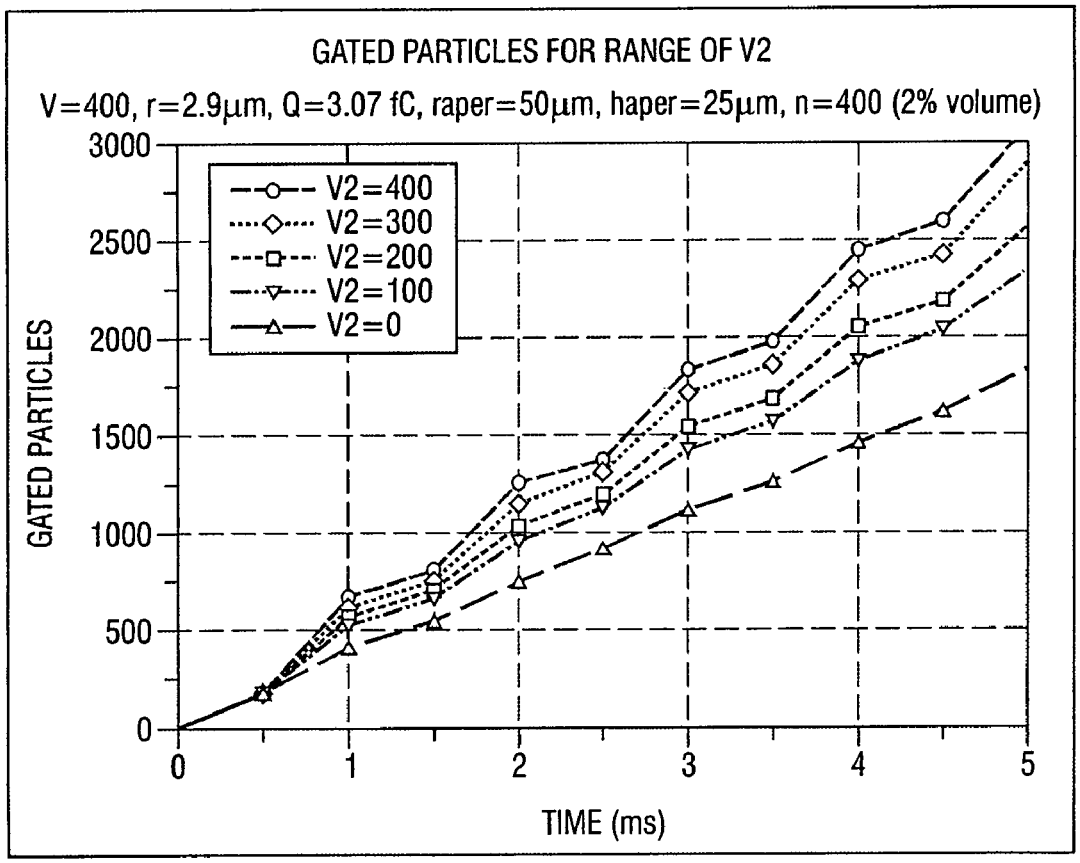
FIG. 24 is a graph of gated particles as a function of time as the voltage applied to an electrode shown in FIG. 23 is varied in magnitude.

FIG. 24 is a graph of gated particles versus time where the voltage of one of the electrodes of the gate is varied. The results of FIGS. 24 and 25 were obtained under conditions in which a constant supply of 400 particles in air at 2 percent by volume were provided. The particles had a radius of about 2.9 μm and a charge magnitude of about −3.07 fC. The aperture had a diameter of about 50 μm and the electrodes were spaced about 25 μm apart. The voltage V1 applied to electrode 134 was 400 V. A curve showing the number of gated particles with electrode 132 having a voltage V2 of 400 V is shown by a dashed line with circle symbols. A curve showing the number of gated particles with electrode 132 having a voltage V2 of 300 V is shown by a dotted line with diamond symbols. A curve showing the number of gated particles with electrode 132 having a voltage V2 of 200 V is shown by a dashed line with square symbols. A curve showing the number of gated particles with electrode 132 having a voltage V2 of 100 V is shown by a dash-dot-dot line with inverted triangle symbols. A curve showing the number of gated particles with electrode 132 having a voltage V2 of 0 volts is shown by a dashed line with triangle symbols.

Figure 25:
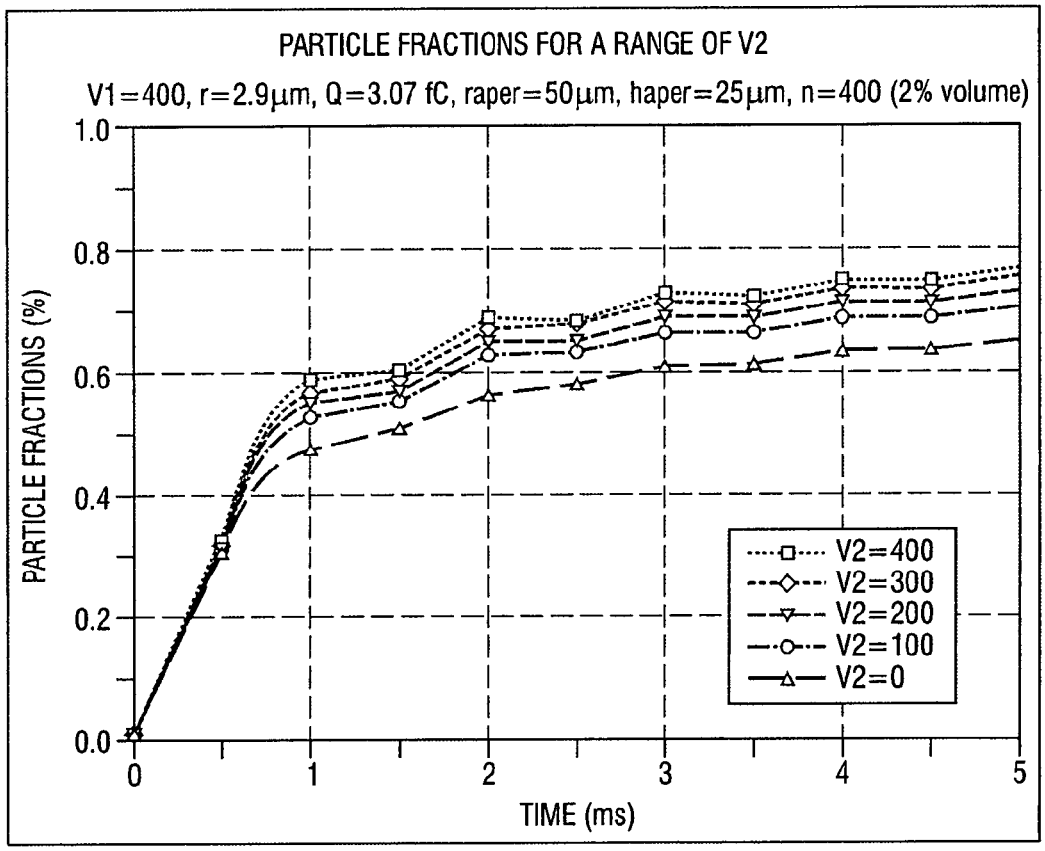
FIG. 25 is a graph of gated particle fractions as a function of time as the voltage applied to an electrode shown in FIG. 23 is varied in magnitude.

FIG. 25 is a graph of particle fractions versus time for results obtained under the same conditions as the results shown in FIG. 24. A curve showing particle fractions for a voltage V2 of 400 V is indicated by a dotted line with square symbols. A curve showing particle fractions for a voltage V2 of 300 V is indicated by a dashed line with diamond symbols. A curve showing particle fractions for a voltage V2 of 200 V is indicated by a dashed line with inverted triangle symbols. A curve showing particle fractions for a voltage V2 of 100 V is indicated by a dash-dot line with circle symbols. A curve showing particle fractions for a voltage V2 of 0 volts is indicated by a dashed line with triangle symbols.

FIG. 26 illustrates a voltage pattern for use on a gate having first and second electrodes, as discussed hereinbefore, with a third electrode spaced therefrom. The first and second electrodes respectively having voltages V1 and V2 applied thereacross. The third electrode having a DC voltage VDC applied thereacross. Such an arrangement is suitable for improving the response time of a gate, as the gate is turned on and turned off, as shown in FIGS. 27 and 28.

FIG. 27 is a graph of gated particle fractions versus time as a gate is turned on for various VDC voltages. A curve for a VDC voltage of +1000 V is indicated by a solid line. A curve for a VDC voltage of 0 volts is indicated by a dashed line with square symbols.

FIG. 28 is a graph of gated particle fractions versus time as a gate is turned off for various VDC voltages. A curve for a VDC voltage of +1000 V is indicated by a dashed line with squares symbols. A curve for a VDC voltage of 0 volts is indicated by a solid line. The results shown in both FIGS. 27 and 28 were obtained under like conditions in which particles having 2.9 μm radius and −3.07 fC charges were gated through an aperture having 50 μm diameter with the electrodes spaced 50 μm apart. The gate operated at a frequency of 1 kHz with voltages of V1 and V2 at 400 V.

As schematically indicated in FIG. 29, gaseous fluid flow can be used to create hydrodynamic drag through passage 110 to balance the upward effects of coulomb forces of particles PA.

FIG. 30 is a graph of gated particles versus airflow velocity through an aperture. The results shown in FIG. 30 were obtained under conditions in which a constant supply of 100 particles was provided. A curve for an aperture having a 25 μm length is shown by a solid line. A curve for an aperture having a 50 μm length is shown by a dashed line. It will be appreciated from FIG. 30 that a fluid flow having a velocity of 20 cm/s will substantially counter the effects of the coulomb forces and substantially shut off particle flow through the passage.

FIG. 31 illustrates a voltage pattern for voltages V1 and V2 applied to electrodes of a gate as discussed hereinbefore. This voltage pattern is one example of a suitable voltage pattern for shutting off particle flow through a passage in combination with the use of gaseous fluid flow.

While considerable emphasis has been placed on the preferred embodiments of the invention illustrated and described herein, it will be appreciated that other embodiments can be made and that many modifications can be made in the embodiments shown and described without departing from the principles of the present invention. Obviously, such modifications and alterations will occur to others upon reading and understanding the preceding detailed description, and it is intended that the subject invention be construed as including all such modifications and alterations insofar as they come within the scope of the appended claims or the equivalents thereof. Accordingly, it is to be distinctly understood that the foregoing descriptive matter is to be interpreted merely as illustrative of the invention and not as a limitation.

We claim:

1. A system for transporting and selectively sorting particles comprising:

a first wall and a traveling wave grid extending along said first wall;

a second wall having a passage extending therethrough, said passage having a first end and a second end;

a gate operatively associated with said passage, said gate including a first electrode proximate said first end and a second electrode proximate said second end; and, a controller adapted to output a multi-phase electrical signal and in electrical communication with said traveling wave grid and said first and second electrodes of said gate, wherein the controller provides a unipolar voltage pattern to the first and second electrodes such that a voltage is applied to only one of the first and second electrodes at any time.

2. The system of claim 1, wherein said passage is comprised of a plurality of apertures extending through said second wall.

3. The system of claim 2, wherein said plurality of apertures are substantially cylindrical and have a diameter of from about 10 μm to about 250 μm.

4. The system of claim 1 wherein the applied voltage is a positive voltage.

5. The system of claim 1 wherein the applied voltage is a negative voltage.

6. The system of claim 1, wherein the traveling wave grid comprises a plurality of conductors.

7. The system of claim 6 wherein the conductors are formed from a material selected from the group consisting of gold, silver, and copper.

8. The system of claim 1, wherein the controller is adapted to output a multi-phase electrical signal having a frequency of from about 1 Hz to about 5 kHz.

9. The system of claim 1 wherein the gate further includes a third electrode.

10. The system of claim 1 wherein said first wall is substantially cylindrical.

11. The invention of claim 1, wherein said traveling wave grid is a first traveling wave grid, and said system further comprises a continuous particle supply apparatus in fluid communication with said first transport channel, said supply apparatus including a supply housing at least partially defining a supply chamber, and a second traveling wave grid disposed within said supply chamber.

12. The invention of claim 11, wherein said supply apparatus further includes a support wall supported within said supply chamber and said second traveling wave grid extends along at least a portion of said support wall.

13. The invention of claim 12, wherein said support wall is generally cylindrical.

14. The invention of claim 1, wherein said traveling wave grid includes four conductor groups, each having a plurality of conductors, said conductor groups disposed in an interdigitized pattern.

15. The invention of claim 14, wherein said voltage source outputs a four phase voltage signal, and each of said four phases is applied to a different one of said conductor groups.

16. The invention of claim 1, wherein said traveling wave grid is a first traveling wave grid and said gating passage is a first gating passage, said housing further includes a third wall at least partially defining a third transport channel and a second gating passage extending in fluid communication between said second and said third transport channels, and said system further includes a second traveling wave grid extending along said second wall.

* * * * *